US007219617B2

(12) United States Patent
Metcalf

(10) Patent No.: US 7,219,617 B2
(45) **Date of Patent: *May 22, 2007**

(54) WAKE TOWER AND METHOD OF MAKING SAME

(76) Inventor: Robert Metcalf, 12960 Bradley Ave., Sylmar, CA (US) 91342

( * ) Notice: Subject to any disclaimer, the term of this patent is extended or adjusted under 35 U.S.C. 154(b) by 0 days.

This patent is subject to a terminal disclaimer.

(21) Appl. No.: 11/331,601

(22) Filed: Jan. 12, 2006

(65) Prior Publication Data

US 2006/0180072 A1 Aug. 17, 2006

Related U.S. Application Data

(63) Continuation-in-part of application No. 10/751,218, filed on Dec. 31, 2003, now Pat. No. 6,986,321, which is a continuation-in-part of application No. 10/401,644, filed on Mar. 27, 2003, now Pat. No. 6,792,888.

(51) Int. Cl.
*B63B 17/00* (2006.01)

(52) U.S. Cl. ..... 114/364; 114/253

(58) Field of Classification Search ..... 114/253, 114/343, 364

See application file for complete search history.

(56) References Cited

U.S. PATENT DOCUMENTS

| | | | | |
|---|---|---|---|---|
| 6,374,762 | B1 * | 4/2002 | Larson et al. | 114/253 |
| 6,792,888 | B1 * | 9/2004 | Metcalf | 114/364 |
| 6,854,413 | B2 * | 2/2005 | Jackson et al. | 114/343 |
| 6,865,999 | B2 * | 3/2005 | Bierbower, Jr. | 114/253 |
| 6,910,437 | B2 * | 6/2005 | O'Reilly et al. | 114/253 |
| 6,925,957 | B2 * | 8/2005 | Schultz | 114/364 |
| 6,945,188 | B2 * | 9/2005 | Eck et al. | 114/253 |
| 6,986,321 | B2 * | 1/2006 | Metcalf | 114/364 |
| 6,997,131 | B2 * | 2/2006 | Jackson et al. | 114/253 |
| 7,017,509 | B2 * | 3/2006 | Schultz | 114/364 |

* cited by examiner

*Primary Examiner*—Lars A. Olson
(74) *Attorney, Agent, or Firm*—James E. Brunton, Esq.

(57) ABSTRACT

An attractive wake tower assembly of a unique, generally U-Shaped configuration that can be readily pivotally mounted on powerboats of various constructions to enable the wake tower assembly to be pivoted from an upstanding to a lowered position. The wake tower assembly is of a high-strength, simple construction that does not interfere with the visibility of the boat operator. Each of the side members of the assembly has an upper portion and a lower portion, each of which is generally oval in cross section. The lower portion of each of the side members have a first width and the upper portion of each of the side members have a first width; and a bight portion interconnecting the upper portions of the sides, the bight portion being generally circular in cross section.

26 Claims, 28 Drawing Sheets

46
48
62a
69
62
38
34
69
66
60
76

64a
72
73
38
34
48
73
64
60
72

38
9
48
7
76
51
64a
72
64
46
60
62
8
62a
66
76
8
9
38
34

106
106a
108
98
129
120
118a
118
116
116a
125
114
123
124
34

FIG. 26
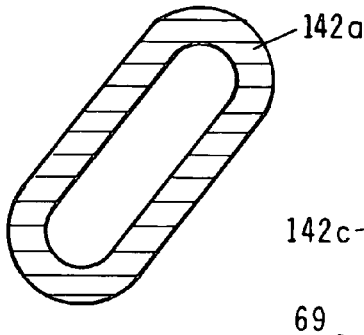
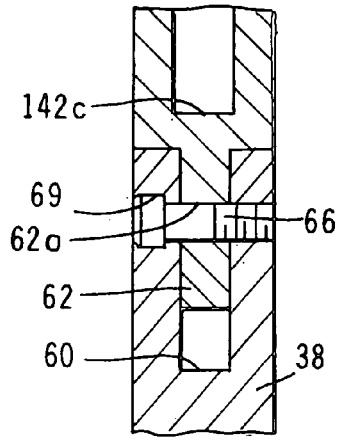
FIG. 27
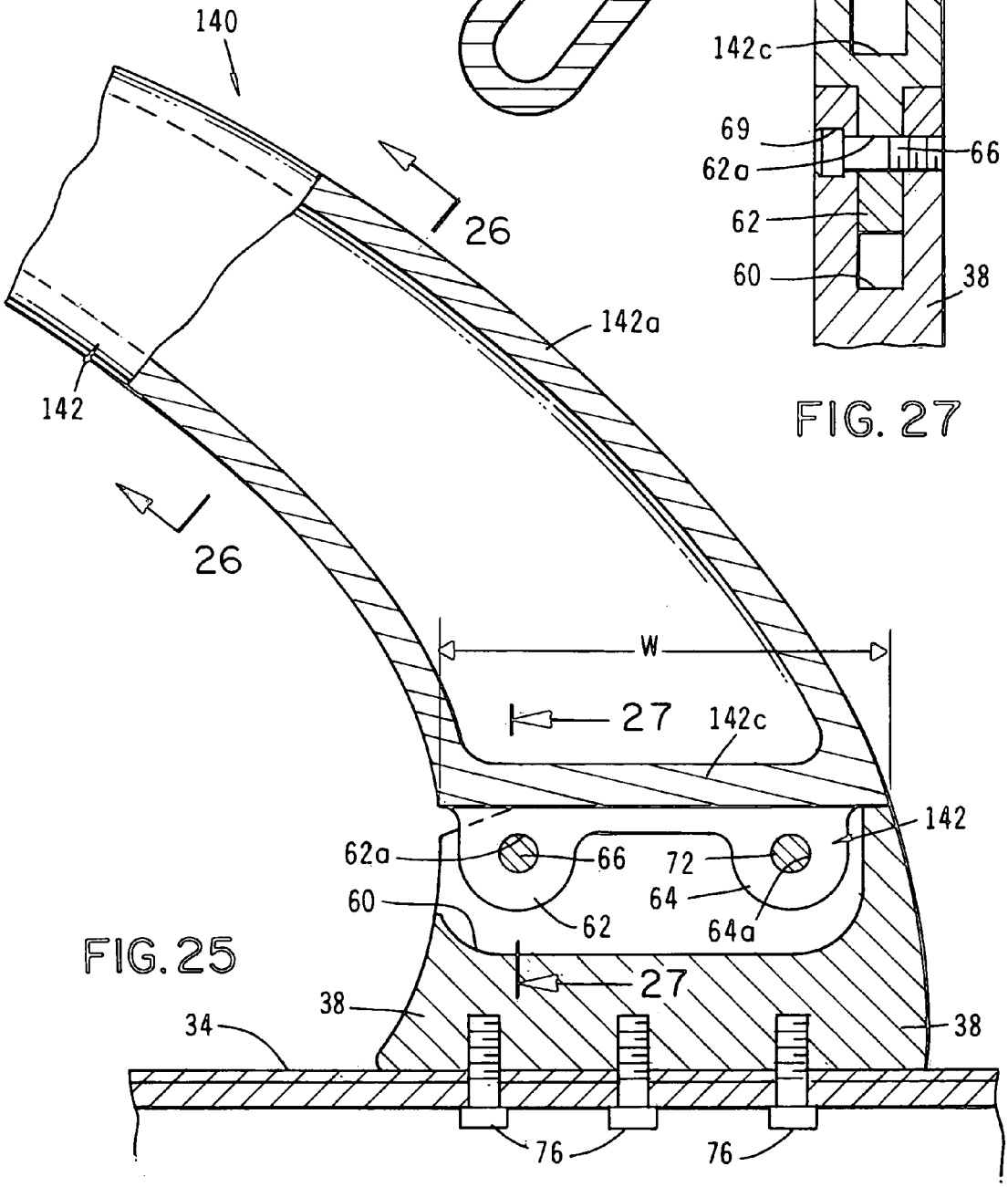
FIG. 25

112
166

164
170
172
168
"O"

36
38
37
39
30
178
154
154a
185
154b
180
176
156
152
170
172
168

170
162
168

166

"O"
168
172
164
170
30
156
178
154a
156b
176
152
154
185
154b
34
156
170
176
154
154a
178
185
34

214
45
45
214a
34
208
238
30
TR
216
218
216
218
214
214
30
214a
224
228
227
222
208
240
34
238
246
238b
236
L
238a
242
243
245

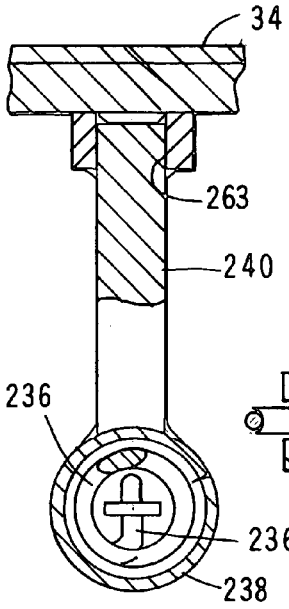
FIG. 47
FIG. 48
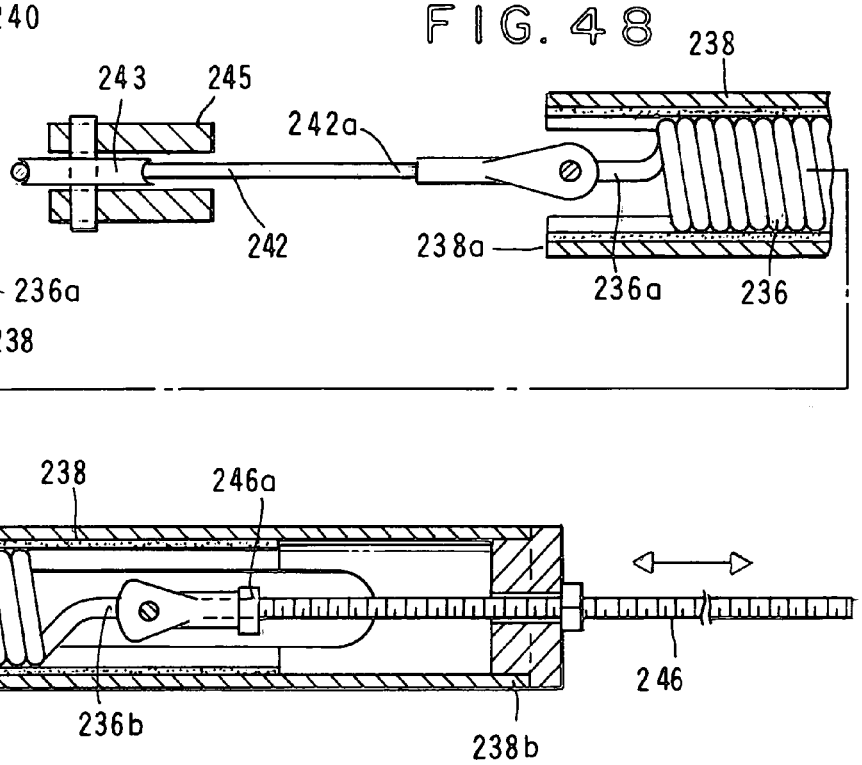
FIG. 45B
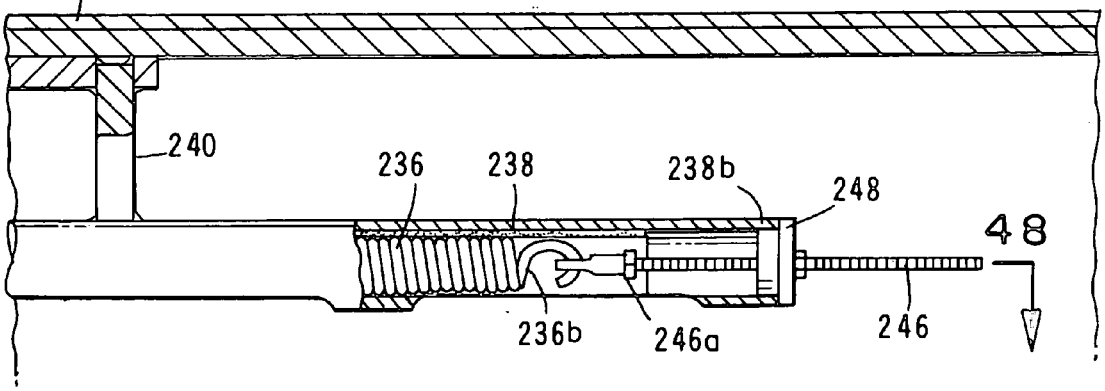

TR
268
266
264
264a
258
34
30
53
274
278
242
243
245
272
279
238
240
236
246
248

264
264a
274
270
278
274a
258
76
54
276
284
263
242
243
272
272a
279
260
242b
262
245
242a
236a
238a
240
238
236
236b
246
238b
248
30
280
242b
242
264a
272a
272
284

264
264a
258
34
276
274a
274
76
272
278
242
272a
284
242b
280
263
242
243
270
260
262
245
242a
236a
238a
240
236
238
240
279
262
34
272a
279
242b
258
263
242
245
243

306
306a
308
308a
310
312
314
314a
314b
316
317
298
302
304
34
30
76
58

WAKE TOWER AND METHOD OF MAKING SAME

BACKGROUND OF THE INVENTION

This is a Continuation-In-Part of Application U.S. Ser. No. 10/751,218 filed Dec. 31, 2003 now U.S. Pat. No. 6,986,321 which is a Continuation-In-Part of Application U.S. Ser. No. 10/401,644 filed Mar. 27, 2003 now U.S. Pat. No. 6,792,888.

FIELD OF THE INVENTION

The present invention relates generally to water sports such as wakeboarding. More particularly, the invention concerns a wake tower of novel construction for use with powerboats for towing a performer behind the boat using a tow rope that is connected to the wake tower.

DISCUSSION OF THE PRIOR ART

In recent years the sport of wakeboarding has become very popular. As the name implies, the wake boarder intentionally rides the wake of the boat and prefers to have as large a wake as possible generated behind the boat. Experience has shown that, to take full advantage of the wake generated by the boat, it is preferable to anchor the towline used to tow the wake boarder at a relatively high elevation above the deck of the boat. Accordingly, a large number of elevated wake towers of various constructions have been suggested in the past.

Typically, the prior art wake towers comprise a rather large and somewhat elaborate framework that is affixed to the boat deck. Such prior art wake towers are heavy and generally quite cumbersome to install and remove from the boat. Further, such towers may interfere with the boat's passage beneath bridges and other types of overpasses. Additionally, because of the complexity of the framework of several of the prior art wake towers, visibility of the operator of the boat can be impaired. Exemplary of prior art wake towers are those illustrated and described in U.S. Pat. No. 5,979,350 issued to Larson, et al., and U.S. Pat. No. 6,193,819 issued to Larson, et al.

To accommodate the overhead clearance problem, certain of the prior art wake tower structures can be dismantled if necessary. However, such prior art structures often have questionable structural stability when erected and can present substantial safety hazards after being disassembled. For example, after the wake tower structures have been disassembled they can present a substantial tripping hazard to passengers on the boat especially when the boat is being rocked by waves. Further, in their dismantled configuration, the wake tower structures typically undesirably reduce the usable space on the boat deck.

Another approach to accommodating overhead clearance problems has been to construct a wake tower assembly that is pivotally interconnected with the boat so that the wake tower can be moved from an elevated position to a lowered position. Exemplary of this prior art approach is a wake tower assembly sold by the Titan Company of Rancho Cordova, Calif.

SUMMARY OF THE INVENTION

By way of summary, one form of the wake tower assembly of the present invention comprises a first base member that can be connected to the gunwale on one side of a power boat; a second base member that can be connected to the gunwale on the opposite side to of a power boat; a generally U-shaped, structural member having a first curved side connected to the first base member and a second curved side connected to the second base member, each of the sides having an upper portion and a lower portion, each of which is generally oval in cross section; the lower portion of each of the sides having a first width and the upper portion of each of the sides having a second width less than the first width; and a bight portion interconnecting the upper portions of the sides, the bight portion being generally circular in cross section. In one form of the invention, the U-shaped structural member can be pivoted downwardly toward the bow of the powerboat and in another form of the invention the U-shaped structural member can be pivoted downwardly toward the stern of the boat.

With the foregoing summary in mind, it is an object of the present invention to provide a highly attractive wake tower assembly of a unique, generally U-shaped configuration that can be readily mounted on powerboats of various constructions.

Another object of the invention is to provide a wake tower assembly of the aforementioned character that includes a novel counter-balancing means for yieldably resisting movement of the structural assembly toward its lowered, stowed position and for assisting in the return of the structural assembly to its upright starting position.

BRIEF DESCRIPTION OF THE DRAWINGS

FIG. 25 is a greatly enlarged cross-sectional view of the area designated as "25" in FIG. 22.

FIG. 26 is a cross-sectional view taken along lines 26—26 of FIG. 25.

FIG. 27 is a cross-sectional view taken along lines 27—27 of FIG. 25.

FIGS. 45A and 45B when considered together comprise an enlarged, cross-sectional view taken along lines 45—45 of FIG. 44.

FIG. 47 is an enlarged, cross-sectional view taken along lines 47—47 of FIG. 45A.

FIG. 48 is an enlarged, cross-sectional view taken along lines 48—48 of FIG. 45A.

DESCRIPTION OF THE INVENTION

Figure 1:
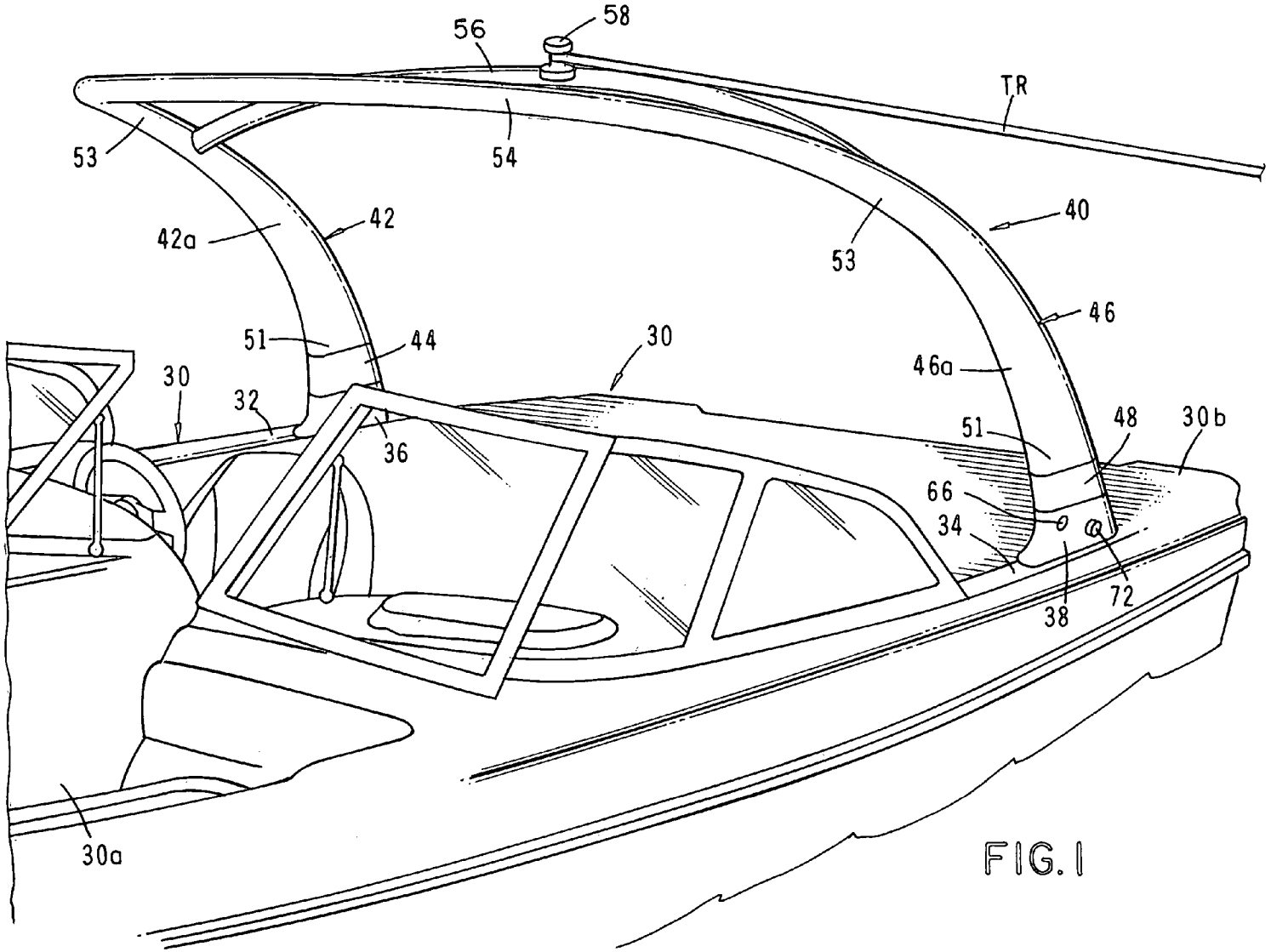
FIG. 1 is a generally perspective view of one form of the wake tower of the present invention shown affixed to the gunwales of a powerboat.
Figure 4:
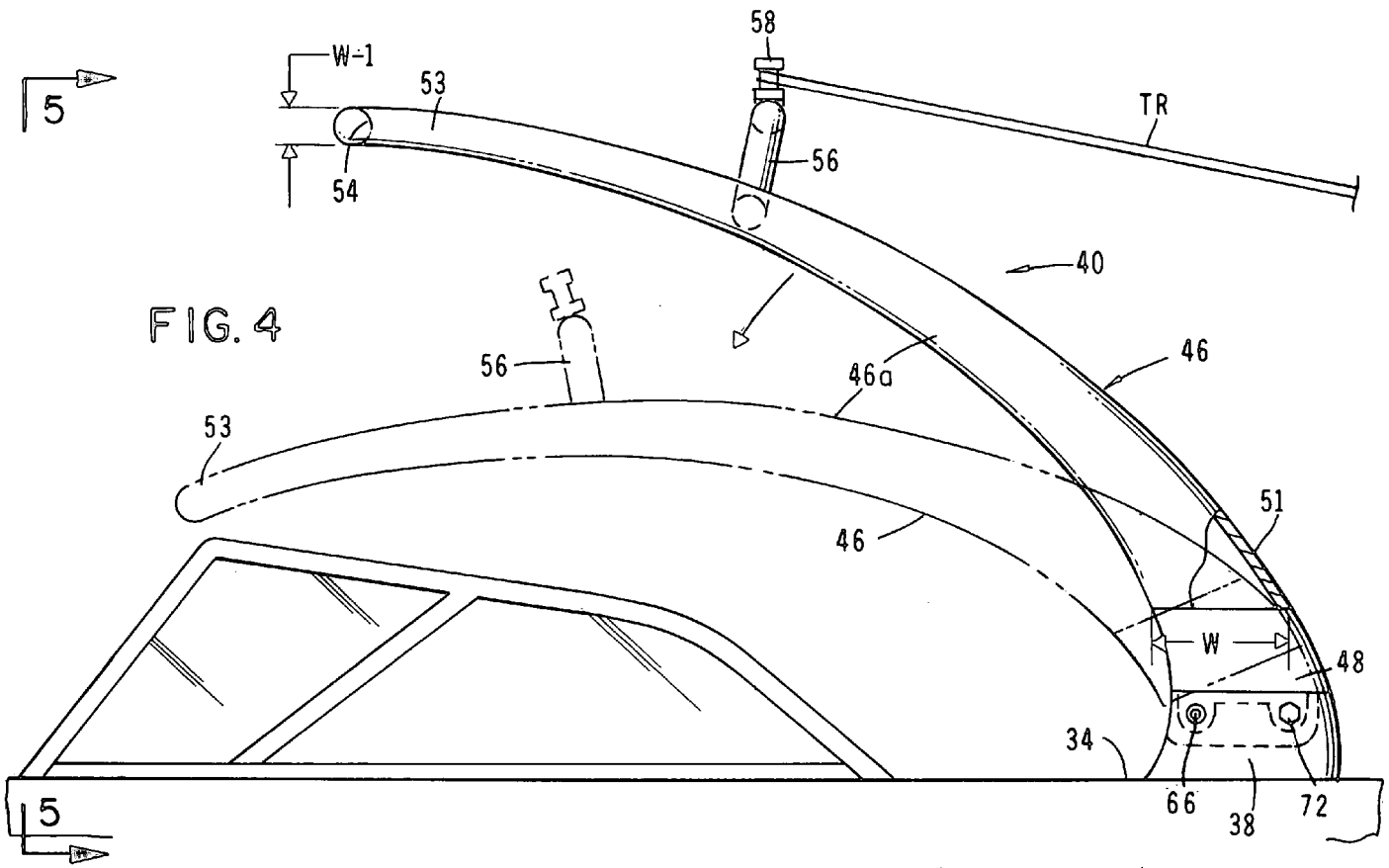
FIG. 4 is a side-elevational view, partly broken away to show internal construction, of the form of the wake tower shown in FIG. 1.
Figure 2:
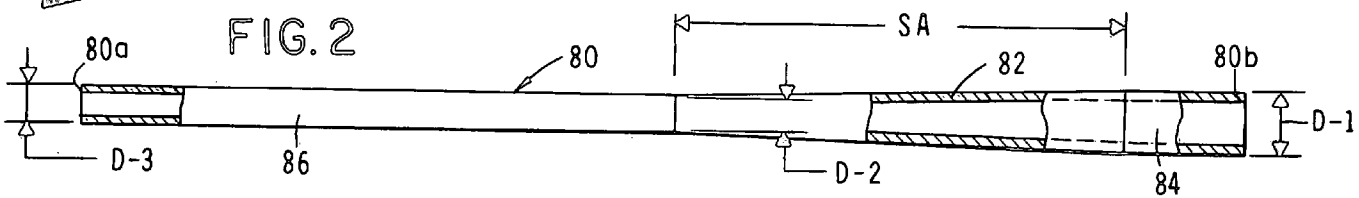
FIG. 2 is a top view, partly in cross section, illustrating one form of the method of the invention for making the wake tower.
Figures 3, 5:
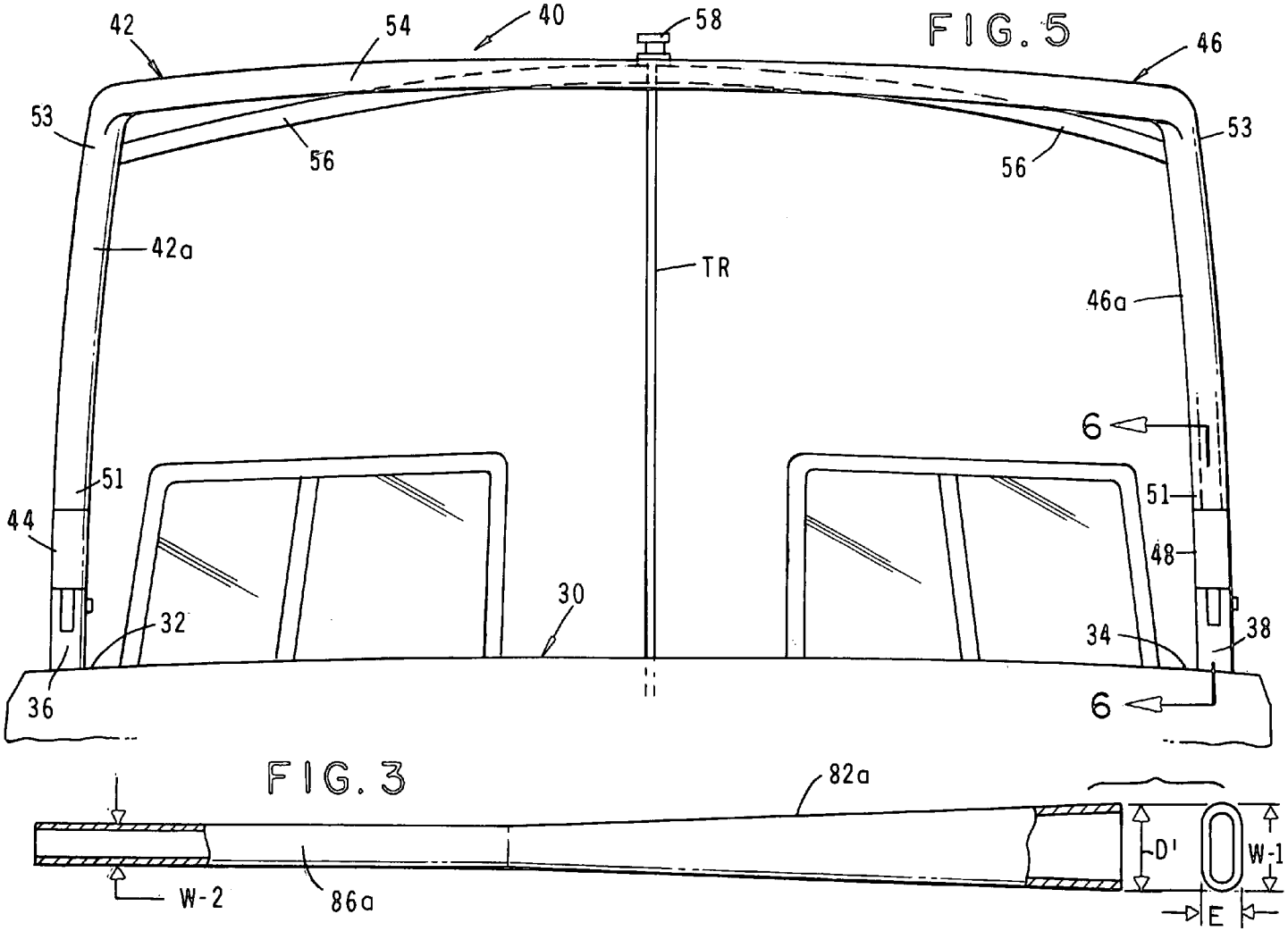
FIG. 3 is a side-elevational view, partly in cross section further illustrating the method of the invention for making the wake tower.
FIG. 5 is a view taken along lines 5—5 of FIG. 4.

Referring to the drawings and particularly to FIGS. 1, 4 and 5, one form of the wake tower of the invention is shown interconnected with a powerboat 30 of conventional construction having a bow portion 30*a* and a stem portion 30*b*. As best seen in FIG. 5, the powerboat also has first and second spaced-apart gunwales 32 and 34 respectively to which the wake tower is connected. In the present form of the invention the wake tower includes an upwardly extending first base member 36 connected to the first gunwale 32 and an upwardly extending second base member 38 connected to said second gunwale 34. The base members 36 and 38 are of a curved configuration and are preferably cast from a lightweight metal such as aluminum.

Interconnected with the base members is a generally U-shaped, upwardly extending structural assembly generally designated by the numeral 40. The structural assembly 40 includes a generally "L"-shaped structural member 42 having a first curved side 42*a* and a cast aluminum first connector segment 44. Structural member 40*a* is connected to aluminum first connector segment 44 by any suitable means such as welding. In a manner presently to be described, connector segment 44 is, in turn, pivotally connected to first base member 36. Structural assembly 40 also includes a second generally "L"-shaped structural member 46 having a curved side 46*a* and a second, cast aluminum connector segment 48 that is connected to second curved side 46*a* by any suitable means such as welding. Connector segment 48 is, in turn, pivotally connected second base member 38.

As will be discussed in greater detail hereinafter, each of the sides of structural assembly 40 is first swaged into the desired configuration and then is strategically formed to create a curved, tapered portion having an oval shape. More particularly, as best seen in FIGS. 1 and 4, each of the sides of the structural assembly 40 includes a lower portion 51 having a first width W and an upper portion 53 having a second width W−1 that is substantially less than said first width W. Structural assembly 40 further includes a bight portion 54 interconnecting upper portions 53 of the sides. As indicated in FIG. 4, bight portion 54 is generally circular in cross section.

In the form of the invention shown in FIGS. 1 through 11, the wake tower further includes a tow rope connector member 56 that is connected to and spans upper portion 53 of the sides 42 and 46. Connected to the connector member 56 is a conventional type of connector 58 to which the tow rope "TR" can be connected.

Figures 6, 7, 8:
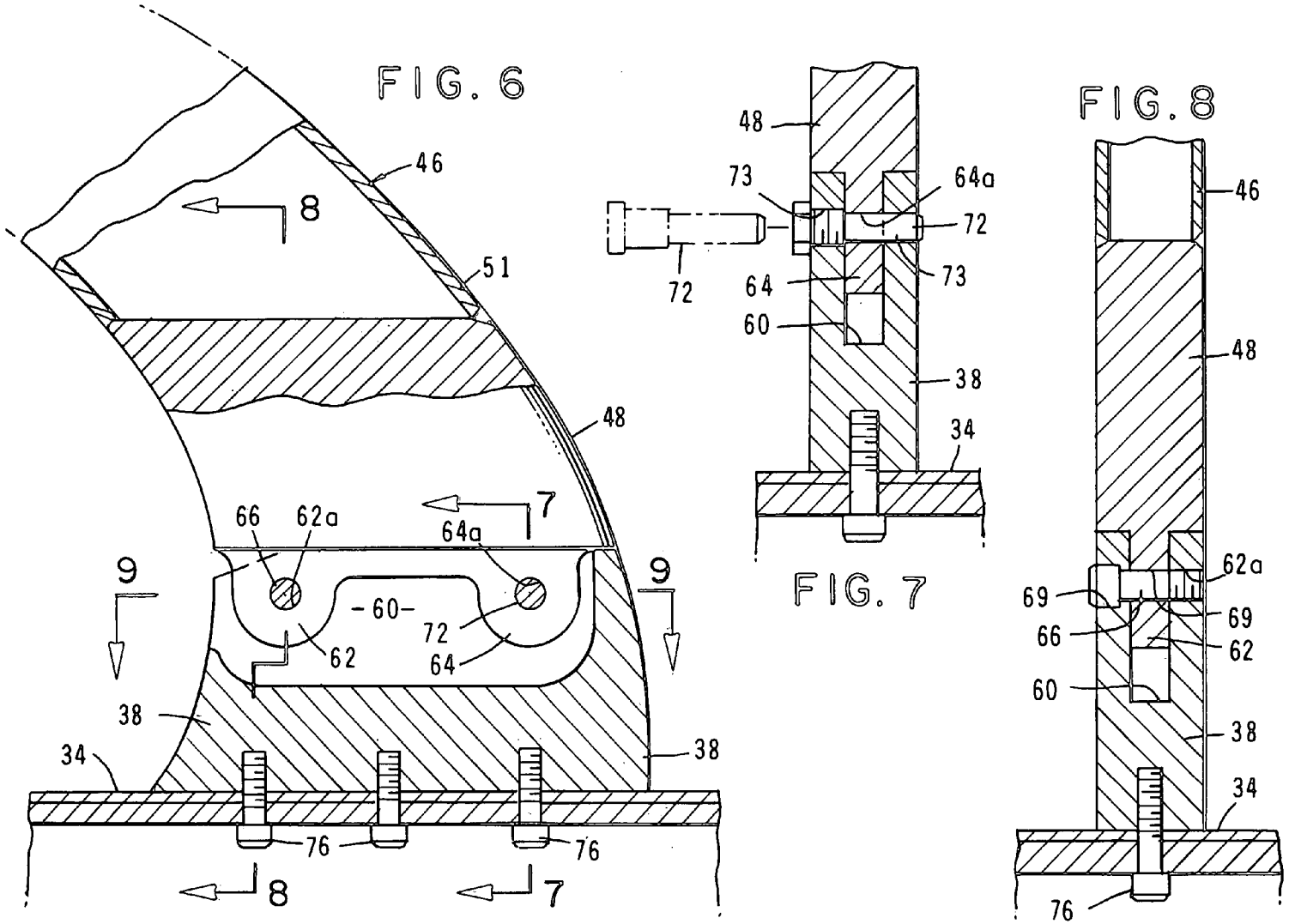
FIG. 6 is a greatly enlarged, cross-sectional view taken along lines 6—6 of FIG. 5.
FIG. 7 is an enlarged, cross-sectional view taken along lines 7—7 of FIG. 6.
FIG. 8 is in enlarged, cross-sectional view taken along lines 8—8 of FIG. 6.

Turning next to FIGS. 6, 7 and 8, a portion of one side of the wake tower of the invention is there shown. It is to be understood that the other side of the wake tower is of a similar construction, but is not shown in the drawings in order to simplify the description. Each of the base members is provided with a cavity 60 and each of the connector segments is provided with a pair of spaced-apart, downwardly extending ears 62 and 64 that are receivable within the base member cavities. As shown in FIG. 6, downwardly extending ear 62 has a bore 62*a* formed therein and, similarly, downwardly extending ear 64 has a bore 64*a* formed therein. Receivable within bore 62*a* is a pivot pin 66 about which side 46 and connector segment 48 can pivot in the manner shown in FIG. 11.

Figure 10:
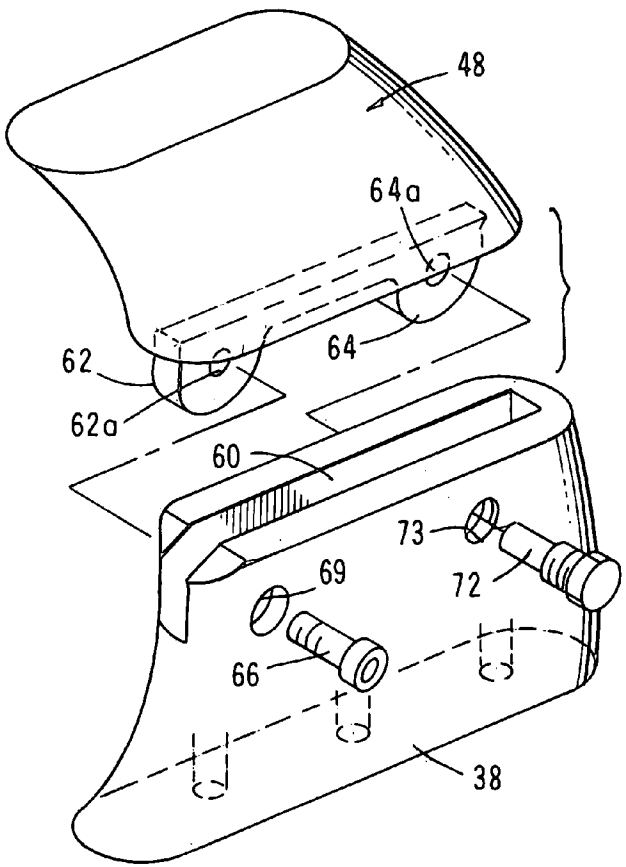
FIG. 10 is a generally perspective, exploded view of one of the base members and one of the connecting segments of the wake tower of the invention.
Figure 9:
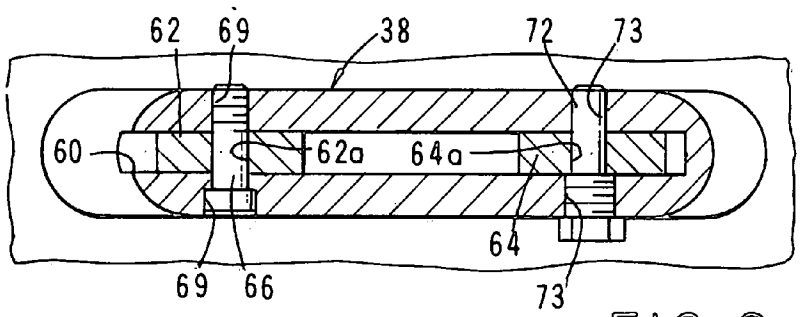
FIG. 9 is in enlarged, cross-sectional view taken along lines 9—9 of FIG. 6.
Figure 11:
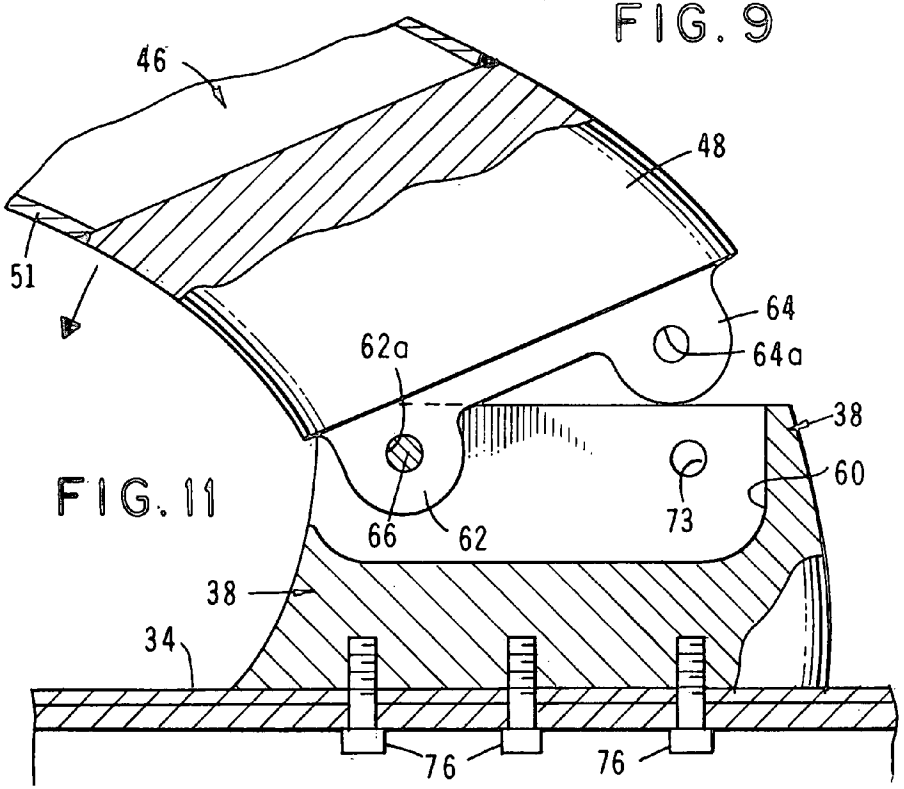
FIG. 11 is a fragmentary, cross-sectional view of the lower portion of one side of the wake tower of the invention illustrating the manner in which the wake tower pivots relative to the base member.

As illustrated in FIGS. 9 and 10, pivot pin 66 extends through aligned bores 69 formed in base member 38. Similarly, a locking pin 72 is receivable within bore 64*a* formed in ear 64. Pivot pin 66 extends through aligned bores 73 formed in base member 38 and, when in position within these openings in the manner shown in FIGS. 6 and 9, prevents pivotal movement of side 46 and connector segment 48 about pivot pin 66. As indicated by the phantom lines in FIG. 7, when the locking pin 72 is removed from the base member, the combination of side 46 and connector segment 48 is free to pivot about pivot pin 66 in the manner shown in FIG. 11.

In accordance with one form of the method of making the wake tower illustrated in FIGS. 1 through 11, the first and second base members 36 and 38 are cast in a conventional manner from a suitable lightweight castable material such as aluminum and are appropriately finished. This done, the base members are interconnected with the powerboat by a plurality of threaded connectors 76 in the manner shown in FIG. 6.

The side members 42*a* and 46*a* are each formed individually by first heating a first length of tubing to an elevated, annealing temperature. This first length of tubing, which by way of example can be 6061-T6 aluminum tubing that has a diameter of approximately 5 inches, a first end 80*a* and a second end 80*b*. In the manner illustrated in FIG. 2, the heated length of tubing is swaged in a conventional manner well known to those skilled in the art to form a first swaged tube 80 having a tapered swaged portion 82 having a first end 84 of first diameter D−1 and a second end 86 of a second lesser diameter D−2 and a uniform diameter portion 86 having a diameter D−3 substantially equal to said second lesser diameter D−2.

Using an appropriate forming dye, the tapered swaged portion 82 of the swaged tube 82 is strategically formed to produce a tapered swaged portion 82*a* and an elongated uniform diameter portion 86*a* (FIG. 3). As illustrated in FIG. 3, swaged portion 82*a* is generally oval-shaped in cross section and has a thickness "E". Swaged portion 82*a* has a width W−1, while uniform diameter portion 86*a* has a lesser width W−2. This swaging step is done in a conventional manner using conventional tooling that is of the character well understood by those skilled in the art.

Following the swaging step, the swaged to first tube 80 is strategically bent into the desired shape to form a first bent tube that is generally "L"-shaped in configuration and generally corresponds to the shape of member 42*a*.

Next, first connector segment 44 is cast in a conventional manner from a light weight castable material such aluminum and is connected by any suitable means such as welding to the bent tube formed by the swaging step to form a first wake tower subassembly 42, which generally corresponds to one-half of the structural assembly 40.

Following the forming of the first wake tower subassembly, a second length of aluminum tubing is swaged and formed in the identical manner described in the preceding paragraphs to produce a second side 46*a*. This done, second connector segment 48 is suitably cast from a light weight metal such as aluminum and is interconnected as by welding was second side 46*a* to form assembly 46 that generally corresponds to the second half of the structural assembly 40.

Next, the elongated, uniform diameter portions of the first and second wake tower subassemblies 42 and 46 are interconnected at their ends as by a welding to form the structural member 40.

After completion of the construction of the structural member 40 in the manner described in the preceding paragraphs, the structural member is pivotally interconnected with the base members 36 and 38 in the manner depicted in FIGS. 6 through 10 of the drawings to form the construction shown in FIGS. 1 and 3. More particularly, the ears formed on each of the connector segments are inserted into the base cavities, the pivot pins 66 are inserted into bores 69 and 62*a* and the locking pins are inserted into bores 73 and 64*a*. With this construction, when it is desired to pivot the structural member into the forwardly stowed position in the manner illustrated in FIG. 11, locking pin 72 are removed from bores 73 and 64*a* to permit the structural member to pivot about pivot pin 66.

Figure 12:
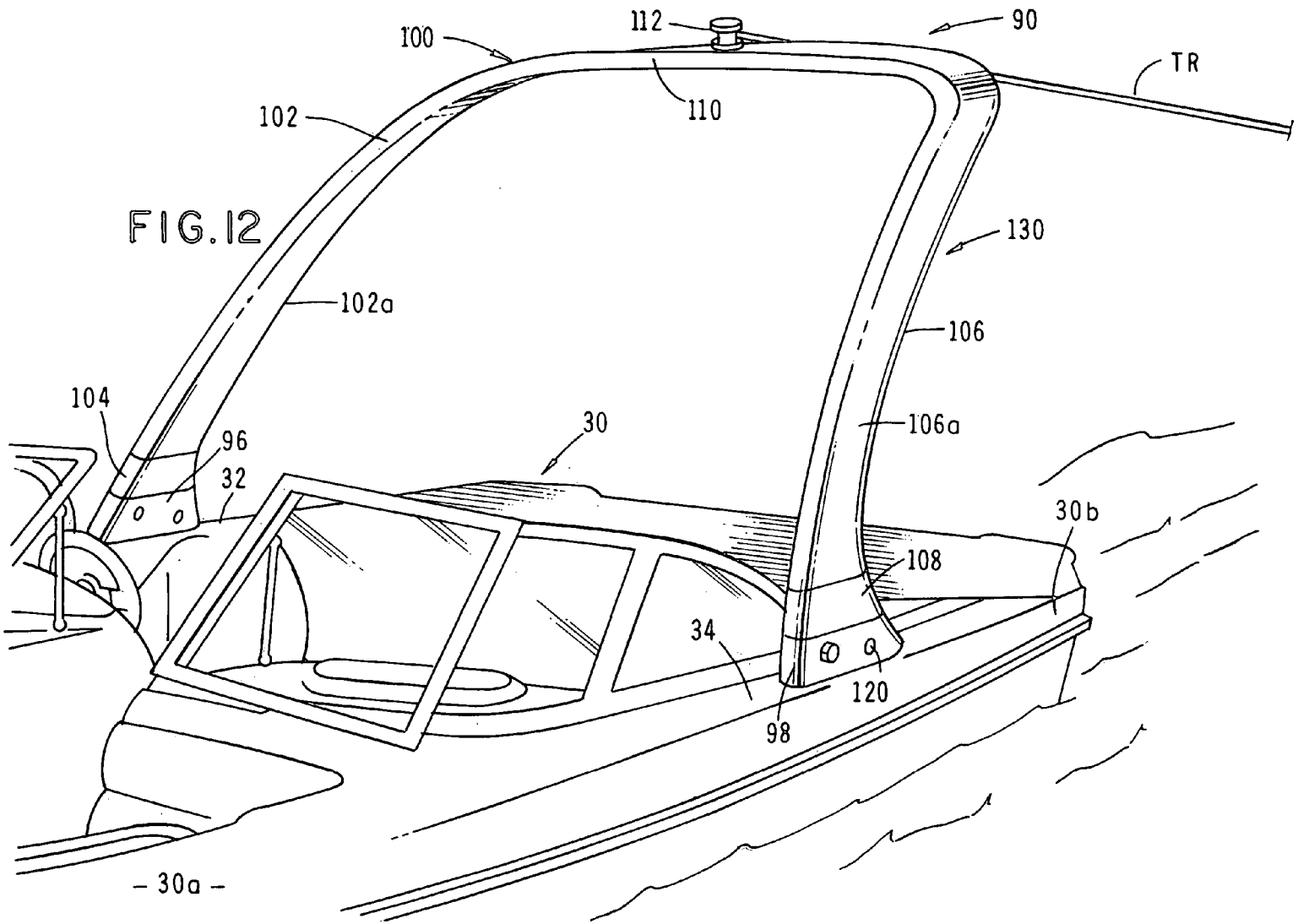
FIG. 12 is a generally perspective view of an alternate form of wake tower of the present invention shown mounted on the gunwales of a powerboat.
Figures 13, 14, 15:
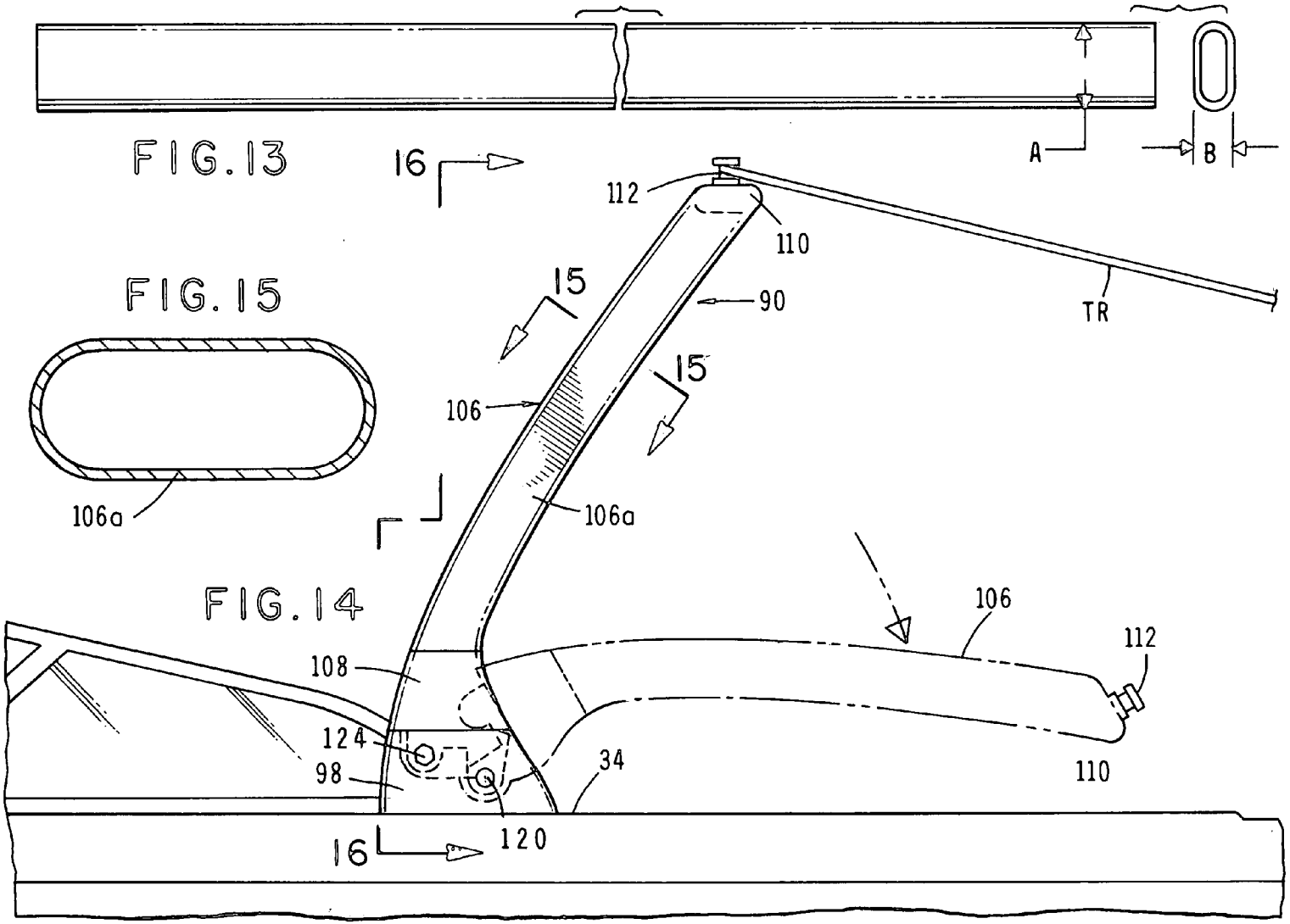
FIG. 13 is a side-elevational view illustrating the manner of making one of the side members of the wake tower shown in FIG. 12.
FIG. 14 is a side-elevational view of the wake tower of the alternate form of the invention shown in FIG. 12.
FIG. 15 is an enlarged, cross-sectional view taken along lines 15—15 of FIG. 14.

Turning next to FIGS. 12 through 21 an alternate form of the wake tower of the invention is shown and generally designated by the numeral 90. This embodiment is similar in many respects to the embodiment shown in FIGS. 1 through 11 and like numerals are used in FIGS. 12 through 21 to identify like components. One of the main differences between this latest form of the invention and the earlier described form resides in the fact that the wake tower slopes rearwardly instead of forwardly and instead of being pivotally movable toward the bow of the boat is pivotally movable toward the stern of the boat as shown in FIG. 14 of the drawings.

Referring to FIG. 12 of the drawings, wake tower 90 is shown interconnected with a powerboat 30 of conventional construction having a bow portion 30*a*, a stern portion 30*b* and first and second spaced-apart gunwales 32 and 34 respectively. In this latest form of the invention, the wake tower includes an upwardly extending first base member 96 that is connected to the first gunwale 32 and an upwardly extending second base member 98 that is connected to said second gunwale 34. The base members 96 and 98 are of a curved configuration and are preferably cast from a lightweight metal such as aluminum.

Interconnected with the base members is a generally U-shaped, upwardly extending structural assembly generally designated by the numeral 100. The structural assembly 100 includes a generally "L"-shaped structural member 102 having a first curved side 102*a* and a cast aluminum first connector segment 104. Structural member 102 is connected to aluminum first connector segment 104 by any suitable means such as welding. In a manner presently to be described, connector segment 104 is, in turn, pivotally connected to first base member 96. Structural assembly 100 also includes a second generally "L"-shaped structural member 106 having a curved side 106*a* and a second, cast aluminum connector segment 108 that is connected to second curved side 106*a* by any suitable means such as welding. Connector segment 108 is, in turn, pivotally connected second base member 98.

As in the earlier described embodiment of the invention, each of the sides of structural assembly 100 is first swaged into the desired configuration and then is strategically formed to create an elongated swaged portion having an oval shape (see FIGS. 13 and 15). As indicated in FIG. 14, in this latest form of the invention, the bight portion 110 of the structural assembly 100 is also generally oval-shaped in cross section. Unlike the earlier described embodiment of the invention, the tow rope TR is directly connected to a connector 112 that is connected to bight portion 110 proximate the center thereof.

Figure 17:
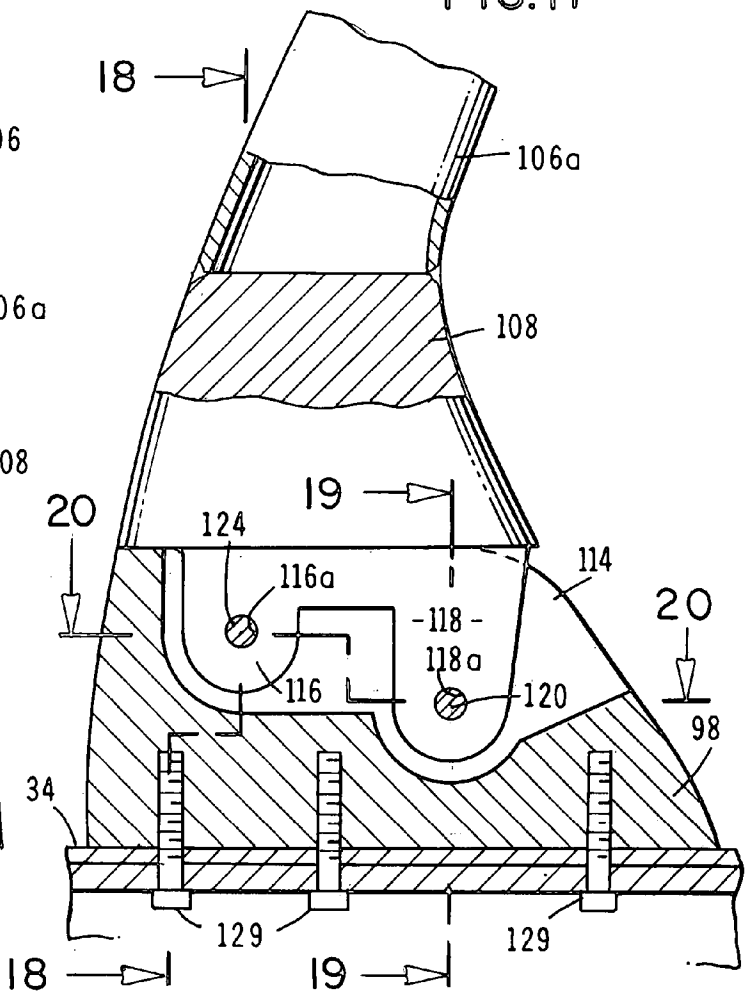
FIG. 17 is a greatly enlarged, cross-sectional view taken along lines 17—17 of FIG. 16.
Figures 18, 19, 20, 21:
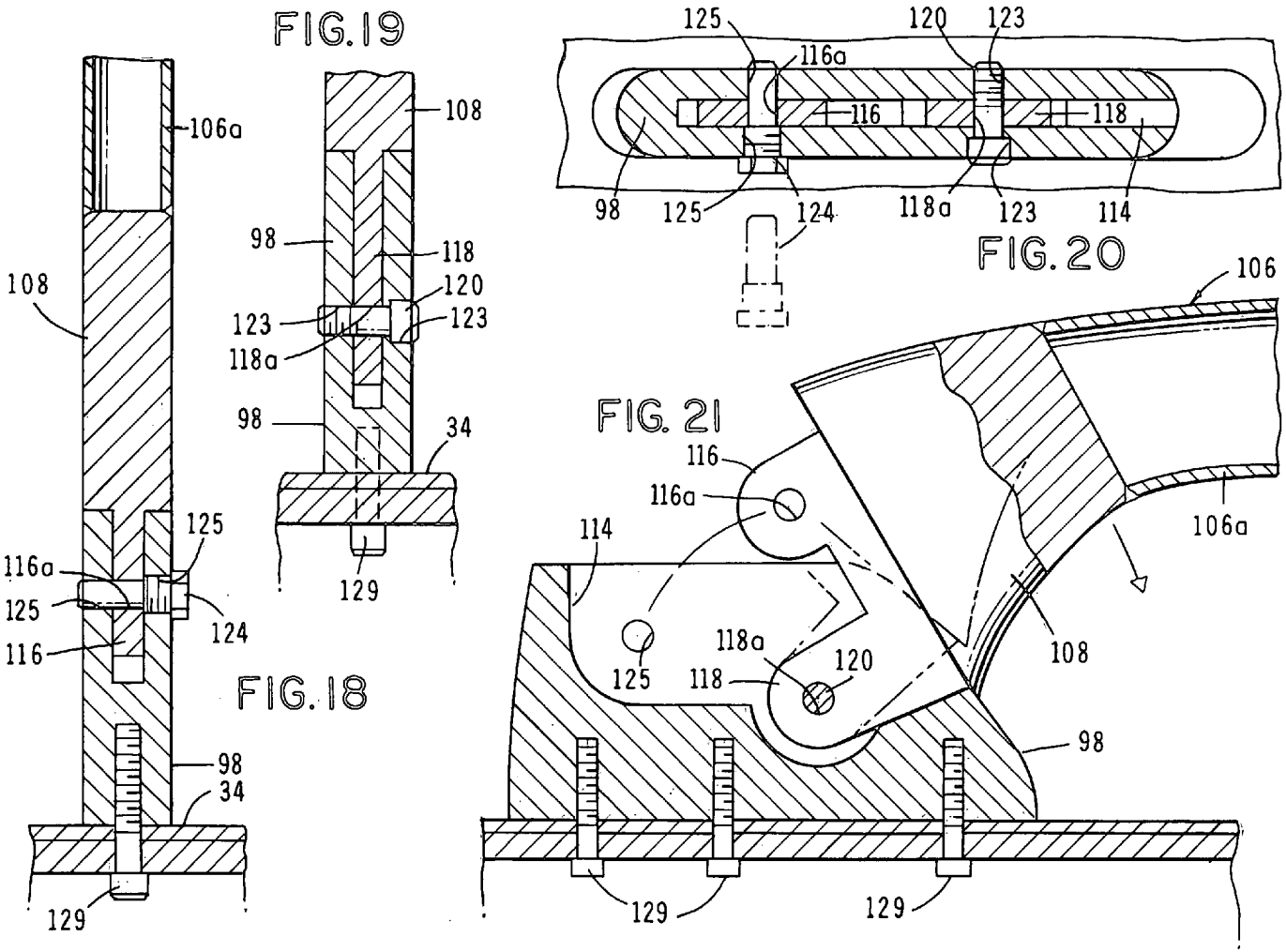
FIG. 18 is a cross-sectional view taken along lines 18—18 of FIG. 17.
FIG. 19 is a cross-sectional view taken along lines 19—19 of FIG. 17.
FIG. 20 is a cross-sectional view taken along lines 20—20 of FIG. 17.
FIG. 21 is a fragmentary, cross-sectional view similar to FIG. 17, but illustrating the rearward pivotal moment of the wake tower of the alternate form of the invention.

Turning next to FIGS. 17 through 21, a portion of one side of the wake tower of this latest form of the invention is there shown. It is to be understood that the other side of the wake tower is of a similar construction, but is not shown in the drawings in order to simplify the description. As best seen in FIGS. 17 and 21, each of the base members is provided with a cavity 114 and each of the connector segments is provided with a pair of spaced-apart, downwardly extending ears 116 and 118 that are receivable within the base member cavities. As shown in FIG. 17, downwardly extending ear 116 has a bore 116*a* formed therein and, similarly, downwardly extending ear 118, which has a length greater than the length of the ear 116, has a bore 118*a* formed therein. Receivable within bore 118*a* is a pivot pin 120 about which side 106 and connector segment 108 can pivot in the manner shown in FIG. 21. As illustrated in FIGS. 19 and 20, pivot pin 120 extends through aligned bores 123 formed in base member 98. Similarly, a locking pin 124 is receivable within bore 116*a* formed in ear 116. Locking pin 124 extends through aligned bores 125 formed in base member 98 and, when in position within these openings in the manner shown in FIGS. 17 and 20, prevents pivotal movement of side 106 and connector segment 108 about pivot pin 120. As indicated by the phantom lines in FIG. 20, when the locking pin 124 is removed from the base member, the combination of side 106 and connector segment 108 is free to pivot about pivot pin 120 in the manner shown in FIG. 21.

In accordance with an alternate form of the method of making the wake tower illustrated in FIGS. 12 through 21, the first and second base members 96 and 98 are cast in a conventional manner from a suitable lightweight castable material such as aluminum and are appropriately finished. This done, the base members can be interconnected with the powerboat by a plurality of threaded connectors 129 in the manner shown in FIG. 17.

The side members 102*a* and 106*a* are each formed individually by first heating to an elevated, annealing temperature a first length of tubing, such as 6061-T6 aluminum tubing that has a diameter of approximately 5 inches. The heated length of tubing is swaged in a conventional manner well known to those skilled in the art to form a first swaged tube 130 of the general configuration shown in FIG. 12.

Using an appropriate forming dye, the swaged tube 130 is strategically formed so that it is generally oval-shaped in cross section. This swaging step is done in a conventional manner using conventional tooling that is of the character well understood by those skilled in the art. Following the swaging step, the swaged to first tube 130 is strategically bent into the desired shape to form a first bent tube that is generally "L"-shaped in configuration and generally corresponds to the shape of member 102*a*.

Next, first connector segment 104 is cast in a conventional manner from a light weight castable material such aluminum and is connected by any suitable means such as welding to the bent tube formed by the swaging step to form a first wake tower subassembly 102, which generally corresponds to one-half of the structural assembly 100.

Following the forming of the first wake tower subassembly, a second length of aluminum tubing is swaged and formed in the identical manner described in the preceding paragraphs to produce a second side 106*a*. This done, second connector segment 108 is suitably cast from a light weight metal such as aluminum and is interconnected as by welding was second side 106*a* to form assembly 106 that generally corresponds to the second half of the structural assembly 100.

Next, the first and second wake tower subassemblies 102 and 106 are interconnected at their ends as by welding to form the structural member 100.

Figure 16:
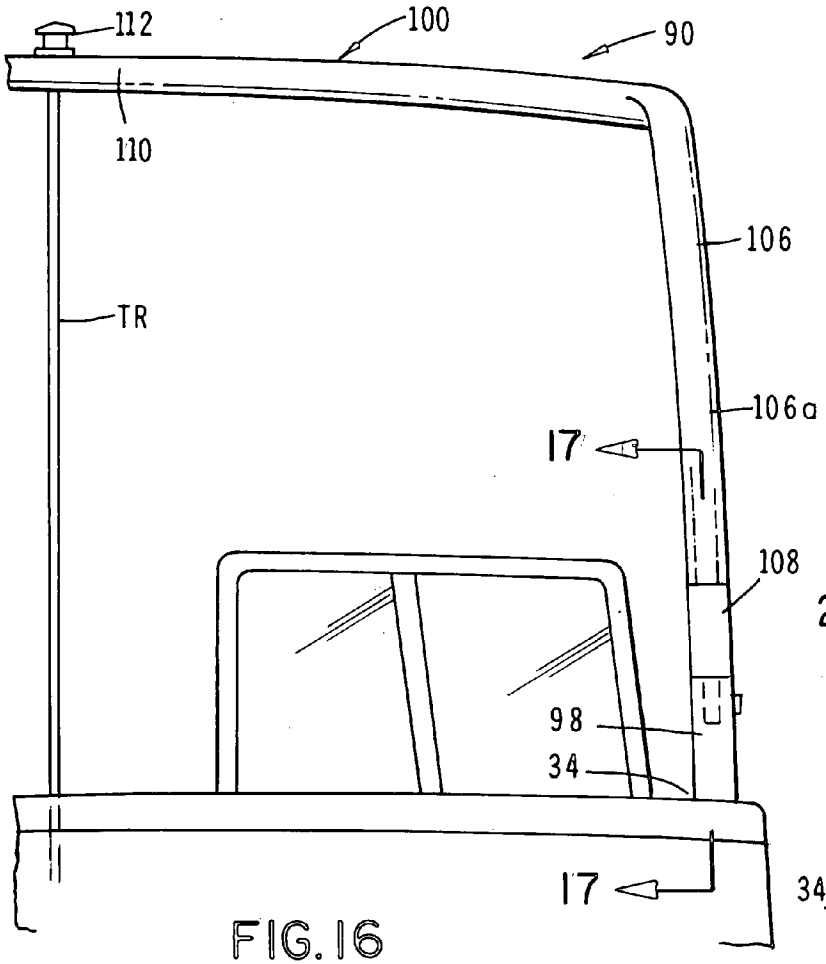
FIG. 16 is a view taken along lines 16—16 of FIG. 14.

After completion of the construction of the structural member 100 in the manner described in the preceding paragraphs, the structural member is pivotally interconnected with the base members 96 and 98 in the manner depicted in FIGS. 6 through 10 of the drawings to form the construction shown in FIGS. 12 and 16. More particularly, the ears formed on each of the connector segments are inserted into the base cavities, the pivot pins 120 are inserted into bores 123 and 118*a* and the locking pins are inserted into bores 125 and 116*a*. With this construction, when it is desired to pivot the structural member rearwardly into the stowed position in the manner illustrated by the phantom lines in FIG. 14, locking pin 124 is removed from bores 125 and 116*a* to permit the structural member to pivot about pivot pin 120.

Referring to FIGS. 22 through 27, still another form of the wake tower of the invention is there shown and generally designated by the numeral 140. This embodiment is also similar in many respects to the embodiment shown in FIGS. 1 through 11 and like numerals are used in FIGS. 12 through 21 to identify like components. The main differences between this latest form of the invention and that earlier described resides in the fact that the wake tower is cast by conventional casting techniques from a lightweight metal such as aluminum or from other suitable castable materials such as plastic.

Referring to FIG. 25 of the drawings, wake tower 140 is interconnected with a powerboat 30 of the previously described, conventional construction having a bow portion, a stern portion and first and second spaced-apart gunwales. As before, the wake tower includes an upwardly extending first base member 36 that is connected to the first gunwale and an upwardly extending second base member 38 that is connected to said second gunwale. The base members are of a curved configuration and are also preferably cast from a lightweight material such as aluminum or the like.

Interconnected with the base members is a generally U-shaped, upwardly extending structural assembly generally designated by the numeral 142. The structural assembly 142 includes a pair of generally "L"-shaped structural members each having a curved side 142*a* and a connector segment 142*b* that includes a basewall 142*c* that closes the lower extremity of the curved sides 142*a*. The connector segments 142*b* are pivotally connected to the first and second base members in the manner previously described to enable the structural assembly to be pivoted into the stowed position as illustrated in FIG. 4. More particularly, as earlier discussed herein, the ears 62 and 64, which form a part of the connector segments, are inserted into the base cavities 60, the pivot pins 66 are inserted into bores 62*a* and the locking pins are inserted into bores 64*a*. With this construction, when it is desired to pivot the structural member into the stowed position in the manner previously described, locking pins 72 are removed from bores 73 to permit the structural member to pivot about pivot pins 66.

Figures 22, 23, 24:
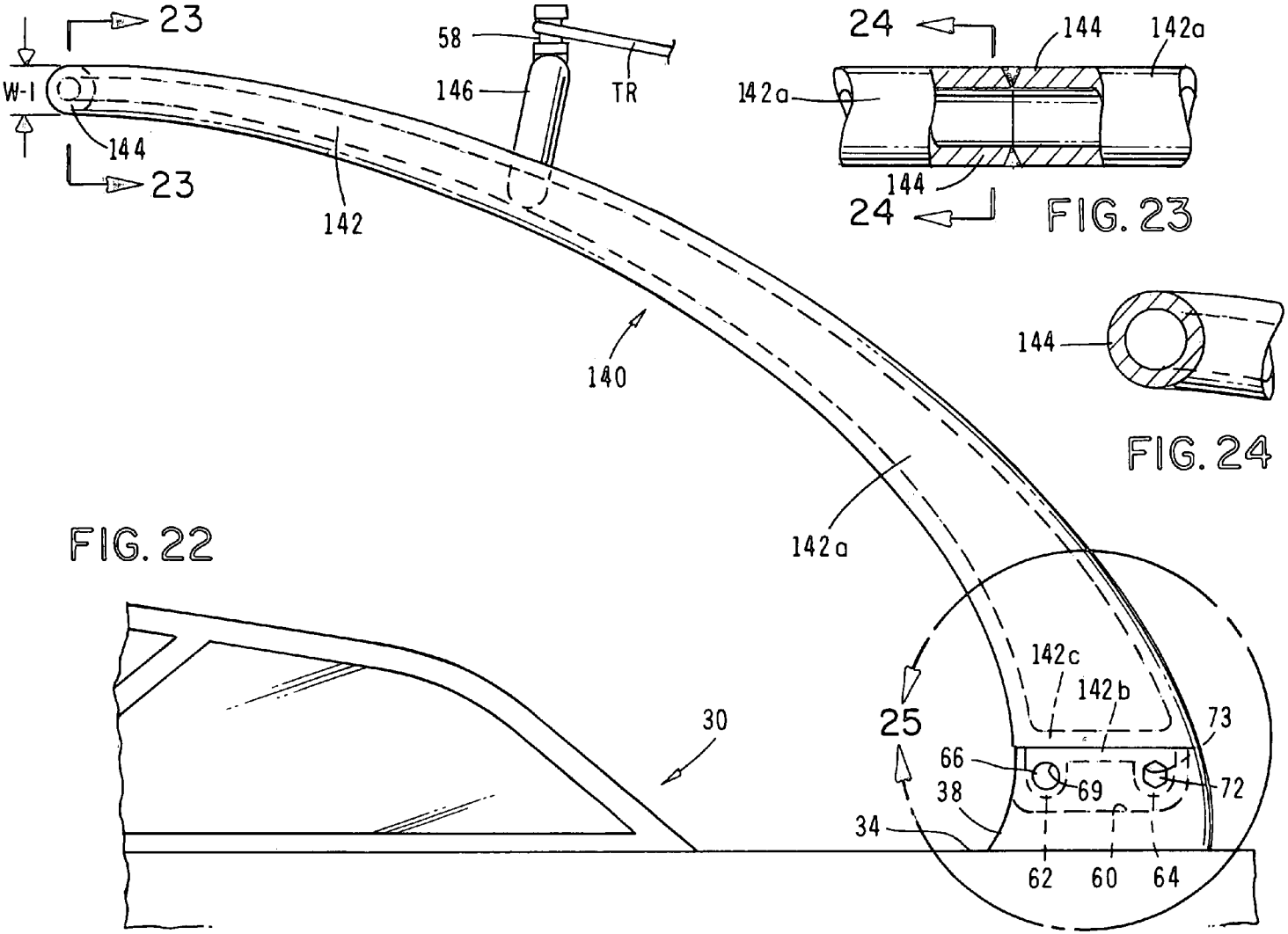
FIG. 22 is a side-elevational view of still another form of the wake tower of the invention that is cast from a metal such as aluminum.
FIG. 23 is an enlarged, cross-sectional view taken along lines 23—23 of FIG. 22.
FIG. 24 is a cross-sectional view taken along lines 24—24 of FIG. 23.

As best seen in FIGS. 22 and 25, each of the sides of the structural assembly 140 includes a lower portion having a first width W and an upper portion having a second width W−1 that is substantially less than said first width W. Structural assembly 140 further includes a bight portion 144 that interconnects the upper portions of the sides (FIG. 22). As indicated in FIGS. 22, 23 and 24, bight portion 144 is generally circular in cross section. At the time of assembly of the structural assembly 142, the bight portions are interconnected together by any suitable means such as welding (see FIG. 23). As illustrated in FIG. 26, the sides of the structural assembly are generally oval in cross section. It is to be understood that the two sides of the wake tower 140 are of a similar construction, but only one side a shown in the drawings in order to simplify the specification.

In this latest form of the invention, like the form of the invention shown in FIGS. 1 through 11, the wake tower 140 further includes a tow rope connector member 146 that is connected to and spans upper portion of the sides 142*a*. Connected to the connector member 146 is a conventional type of connector 58 to which the tow rope "TR" can be connected.

Referring to FIGS. 28 through 42 still another form of the wake tower of the invention is there shown and generally designated by the numeral 150. This embodiment is also similar in some respects to the embodiment shown in FIGS. 1 through 11 and like numerals are used in FIGS. 28 through 42 to identify like components. One of the main differences between this latest form of the invention and the earlier described form resides in the fact that the side portions of the wake tower are of a different shape and of a different cross-sectional configuration.

Figure 28:
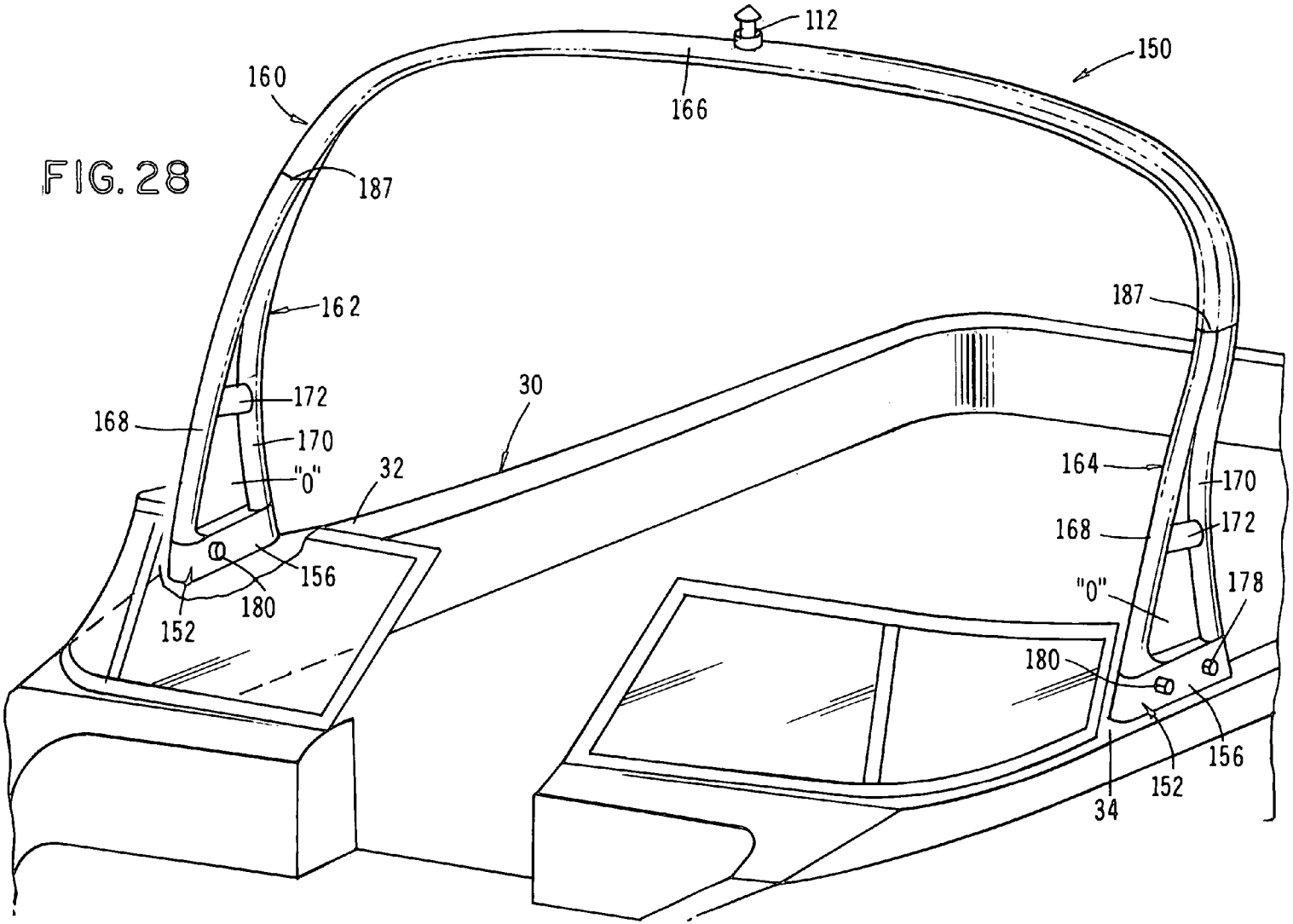
FIG. 28 is a generally perspective view of still another form of the wake tower of the present invention shown affixed to the gunwales of a powerboat.
Figure 29:
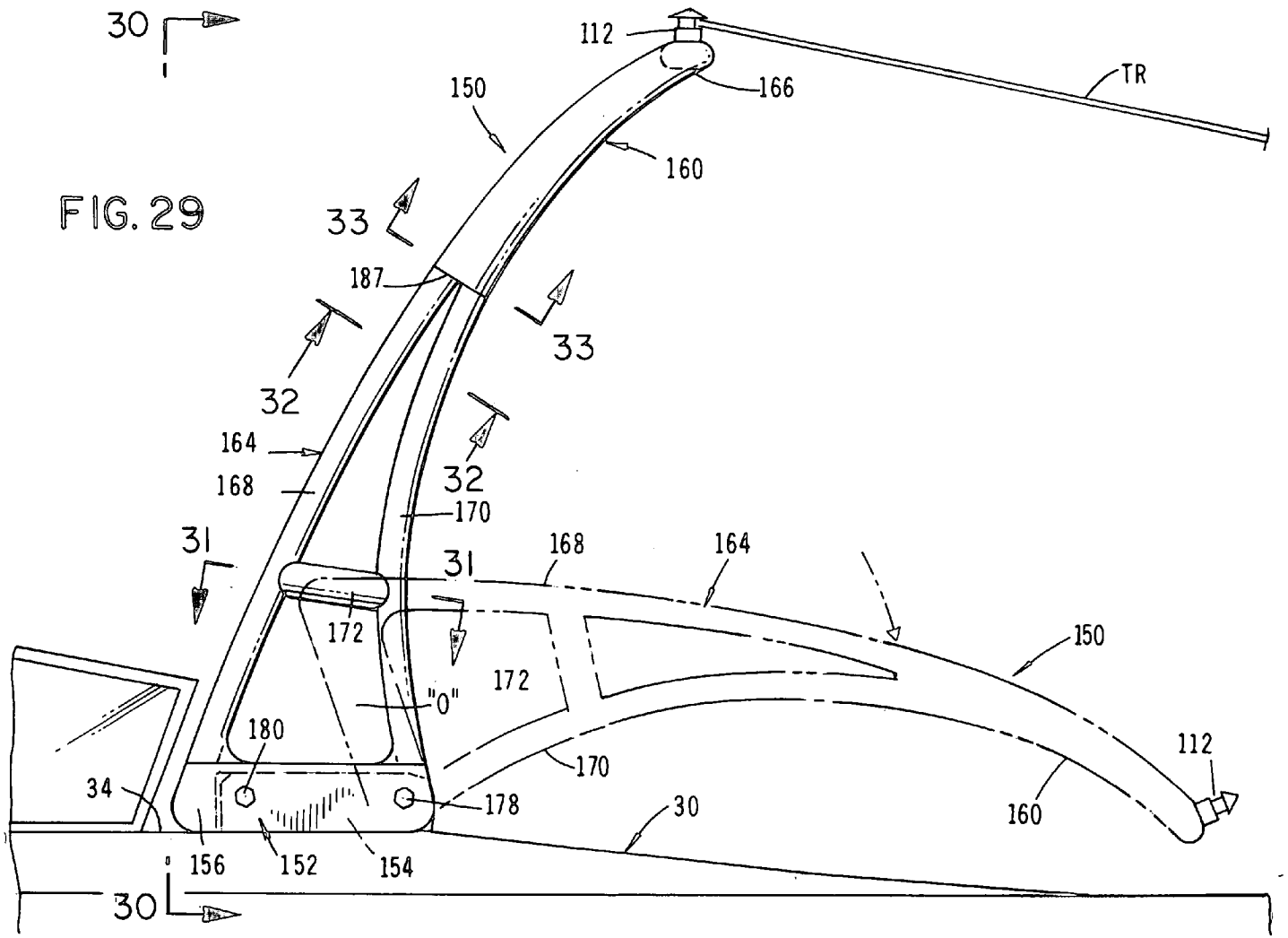
FIG. 29 is a side-elevational view, of the form of the wake tower shown in FIG. 28.
Figure 30:
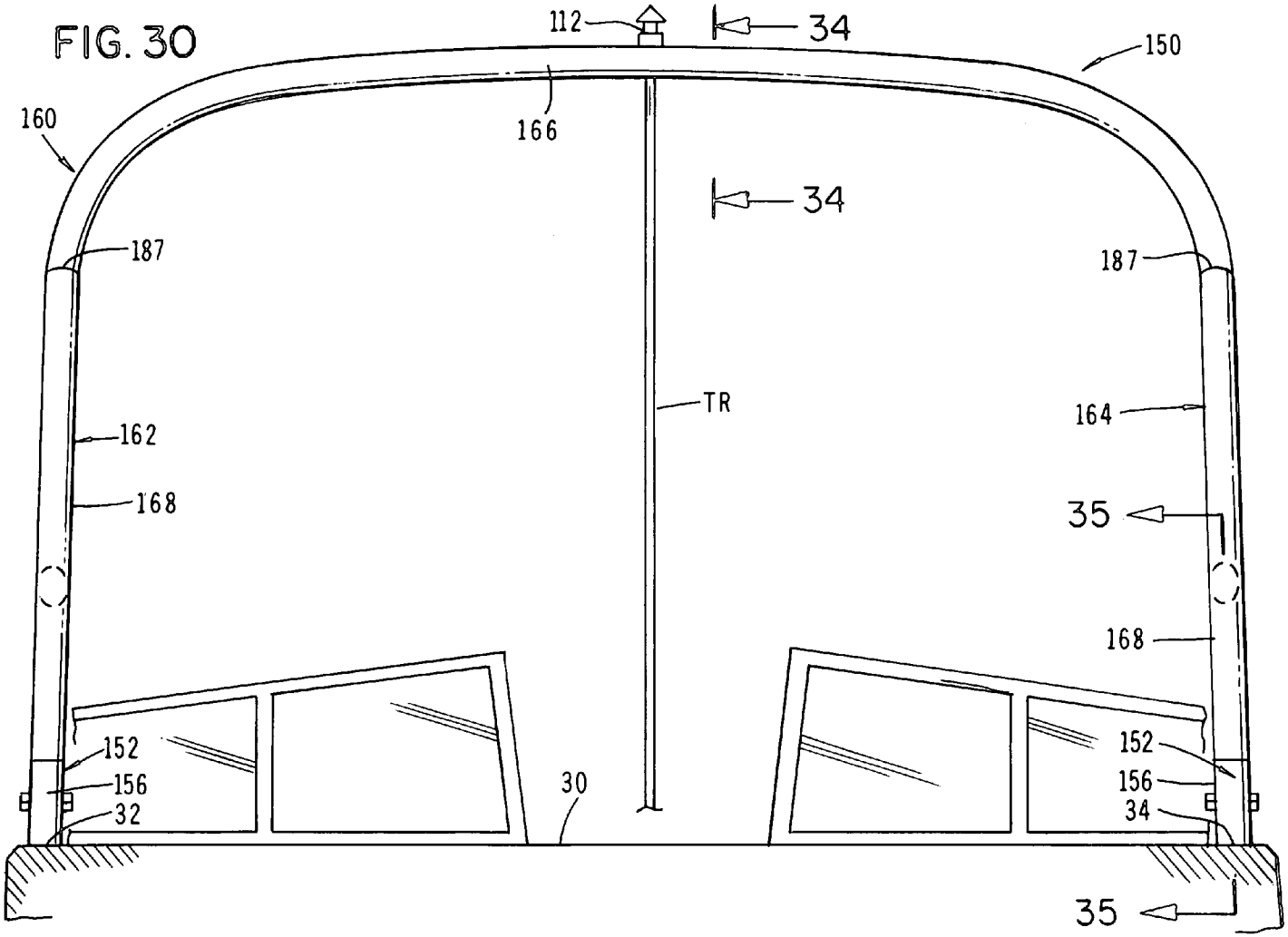
FIG. 30 is a view taken along lines 30—30 of FIG. 29.
Figures 31, 32, 33, 34, 35:
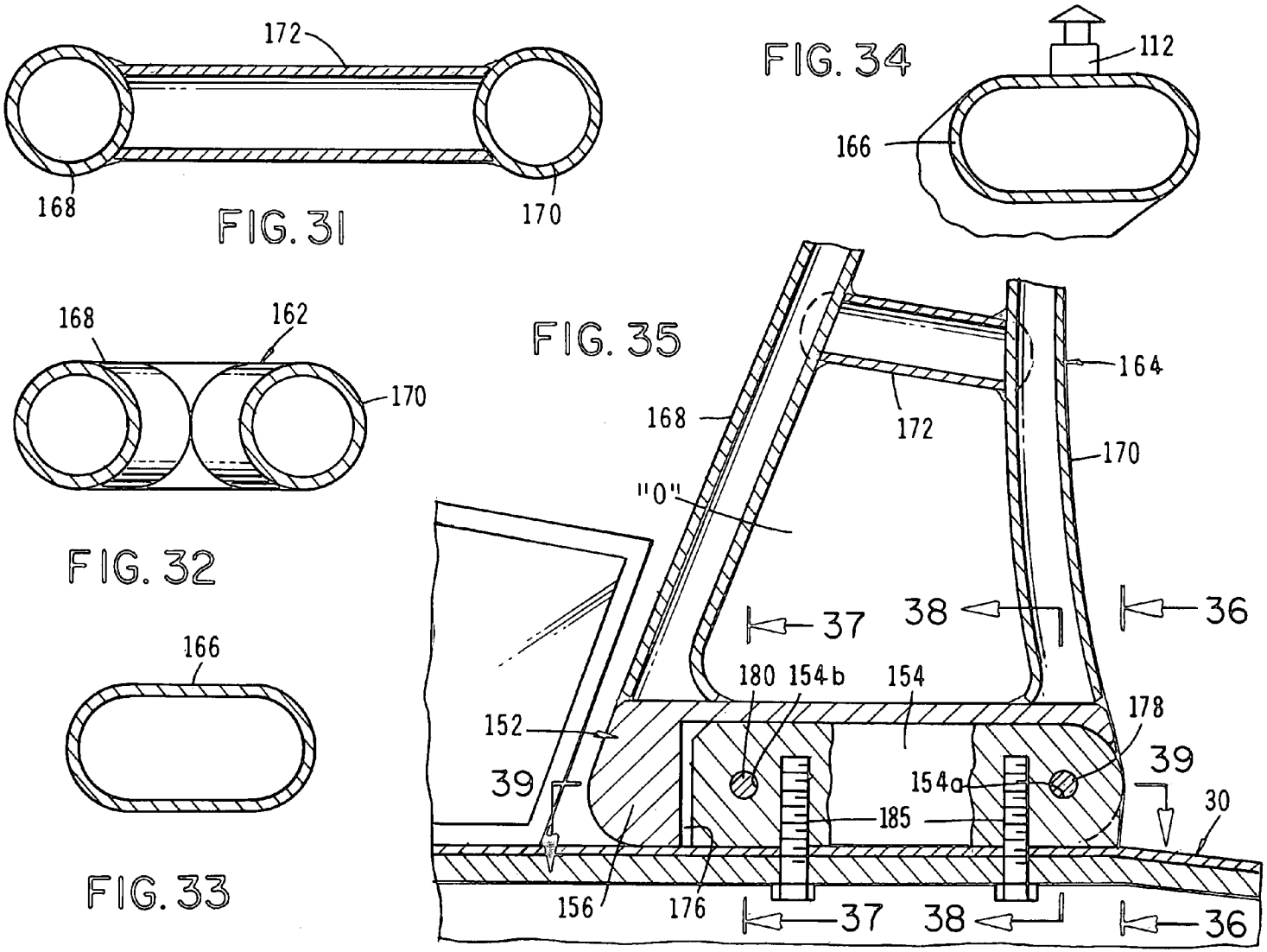
FIG. 31 is an enlarged, cross-sectional view taken along lines 31—31 of FIG. 29.
FIG. 32 is an enlarged, cross-sectional view taken along lines 32—32 of FIG. 29.
FIG. 33 is an enlarged, cross-sectional view taken along lines 33—33 of FIG. 29.
FIG. 34 is an enlarged, cross-sectional view taken along lines 34—34 of FIG. 30.
FIG. 35 is an enlarged, cross-sectional view taken along lines 35—35 of FIG. 30.
Figure 36:
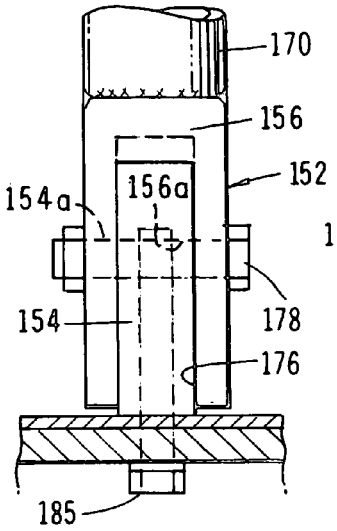
FIG. 36 is an enlarged, cross-sectional view taken along lines 36—36 of FIG. 35.
Figure 37:
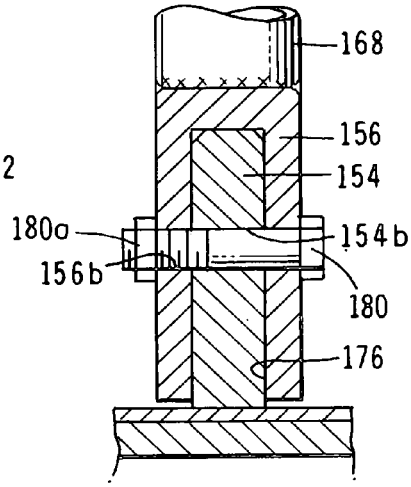
FIG. 37 is an enlarged, cross-sectional view taken along lines 37—37 of FIG. 35.
Figure 38:
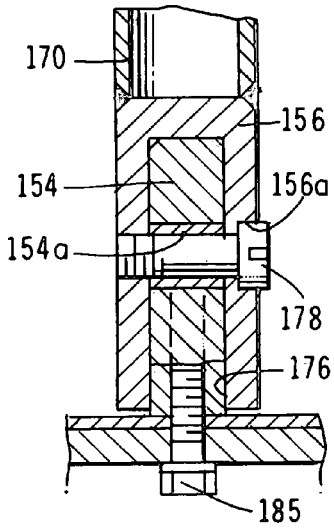
FIG. 38 is a cross-sectional view taken along lines 38—38 of FIG. 35.
Figure 39:
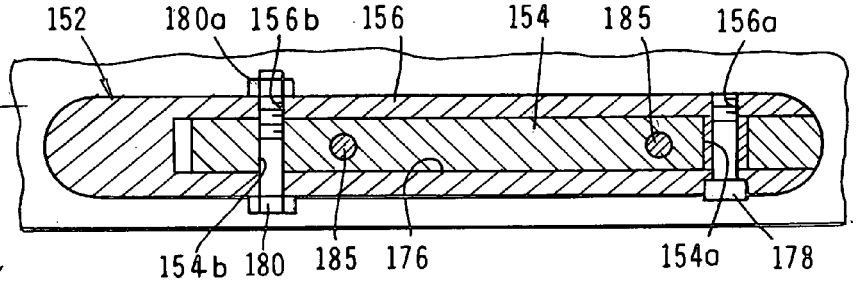
FIG. 39 is a cross-sectional view taken along lines 39—39 of FIG. 35.
Figure 40:
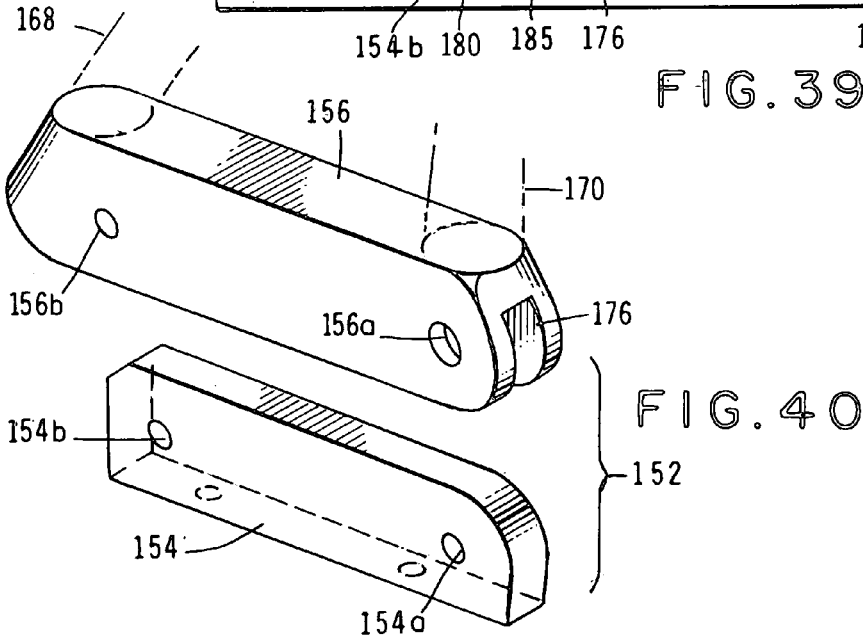
FIG. 40 is a generally perspective, exploded view of the base assembly shown in FIGS. 35 through 39.
Figures 41, 42:
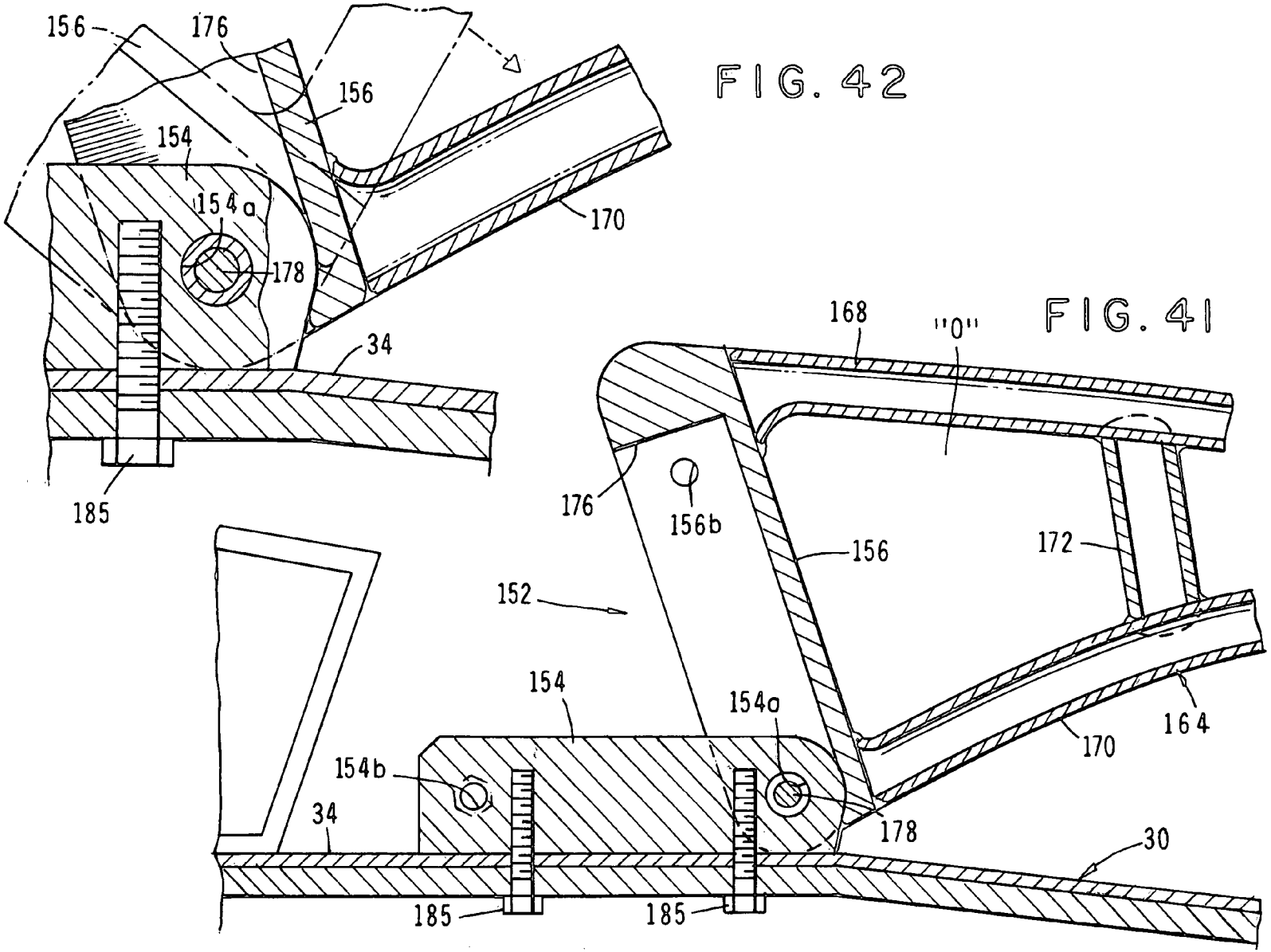
FIG. 41 is a fragmentary, cross-sectional view similar to FIG. 35 showing the generally U-shaped, upwardly extending assembly pivoted into a stowed position.
FIG. 42 is a fragmentary, cross-sectional view similar to FIG. 41 further, illustrating the downward and rearward pivotal movement of the U-shaped assembly.

Referring particularly to FIGS. 28, 29 and 30, wake tower 150 is shown interconnected with a powerboat 30 of conventional construction having a bow portion, a stern portion and first and second spaced-apart gunwales 32 and 34 respectively. In this latest form of the invention, the wake tower includes a pair of upwardly extending base assemblies 152 that are connected to the first and second gunwales 32 and 34. Base assemblies 152, which are of identical construction, each comprise a base connector 154 and a side connector 156 which forms a part of a generally U-shaped, upwardly extending structural assembly generally designated by the numeral 160. In the manner shown in FIG. 41, generally U-shaped, upwardly extending structural assembly 160 is pivotally connected to the base connector (FIG. 35). The base connectors and side connectors are preferably cast from a lightweight metal such as aluminum.

Generally U-shaped structural assembly 160 includes a first side assembly 162, a second side assembly 164 and a bight portion 166. Each of the side assemblies 162 and 164, which are of substantially identical construction, is attached as by welding to one of the side connectors 156 in the manner best seen in FIG. 35. As shown in FIG. 29, a tow rope TR is directly connected to a connector 112 that is connected to bight portion 166 proximate the center thereof.

Referring particularly to FIGS. 31, 32 and 35 it can be seen at that each of the side assemblies 162 and 164 comprises a pair of spaced-apart, generally tubular members 168 and 170 which curve upwardly and inwardly. Intermediate their lengths, the tubular members are interconnected by a generally tubular shaped cross member 172. At their lower extremities, the tubular members are connected to side connectors 156 as by welding and proximate their upper extremities are connected as by welding to bight member 166 which is oval in cross section (FIGS. 28 and 34). Tubular members 168 and 170 cooperate with side connectors 156 to define a generally triangularly shaped opening "O".

Referring next to FIGS. 43 through 50, yet another form of the wake tower of the invention is shown interconnected with a powerboat 30 of conventional construction having a bow portion and a stem portion. This embodiment is similar in some respects to the embodiment shown in FIGS. 1 through 11 and like numerals are used in FIGS. 43 through 50 to identify like components. One of the main differences between this latest form of the invention and the earlier described form resides in the provision of a novel counter-balancing means that is mounted on the under surface of one of the gunwales for yieldably resisting movement of the structural assembly toward its lowered, stowed position and for assisting in the return of the structural assembly to its upright starting position.

Figure 45A:
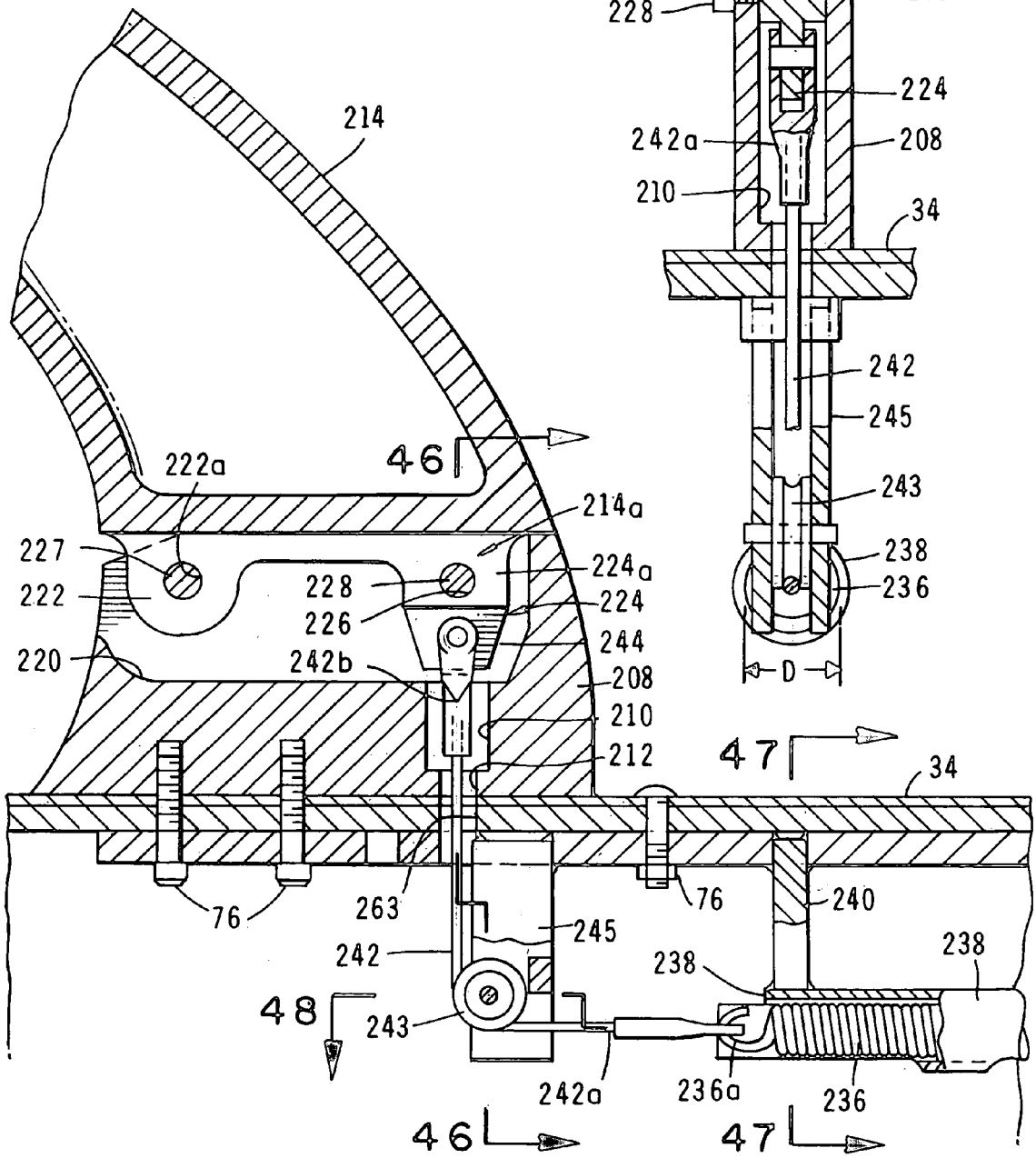

As before the powerboat also has first and second spaced-apart gunwales to which the wake tower is connected. In the present form of the invention the wake tower includes an upwardly extending first base member (not shown) connected to the first gunwale and an upwardly extending second base member 208 connected to said second gunwale 34. The base members are of basically the same curved configuration as before save that base member 208 is provided with a first bore 210 of a first diameter and a second bore 212 of a second diameter (FIG. 45A). Interconnected with the base members is a generally U-shaped, upwardly extending structural assembly 214, which is of similar construction to that previously described. Structural assembly 214 here includes connector segments 214*a*, which are pivotally connected to the first and second base members.

Figures 43, 44:
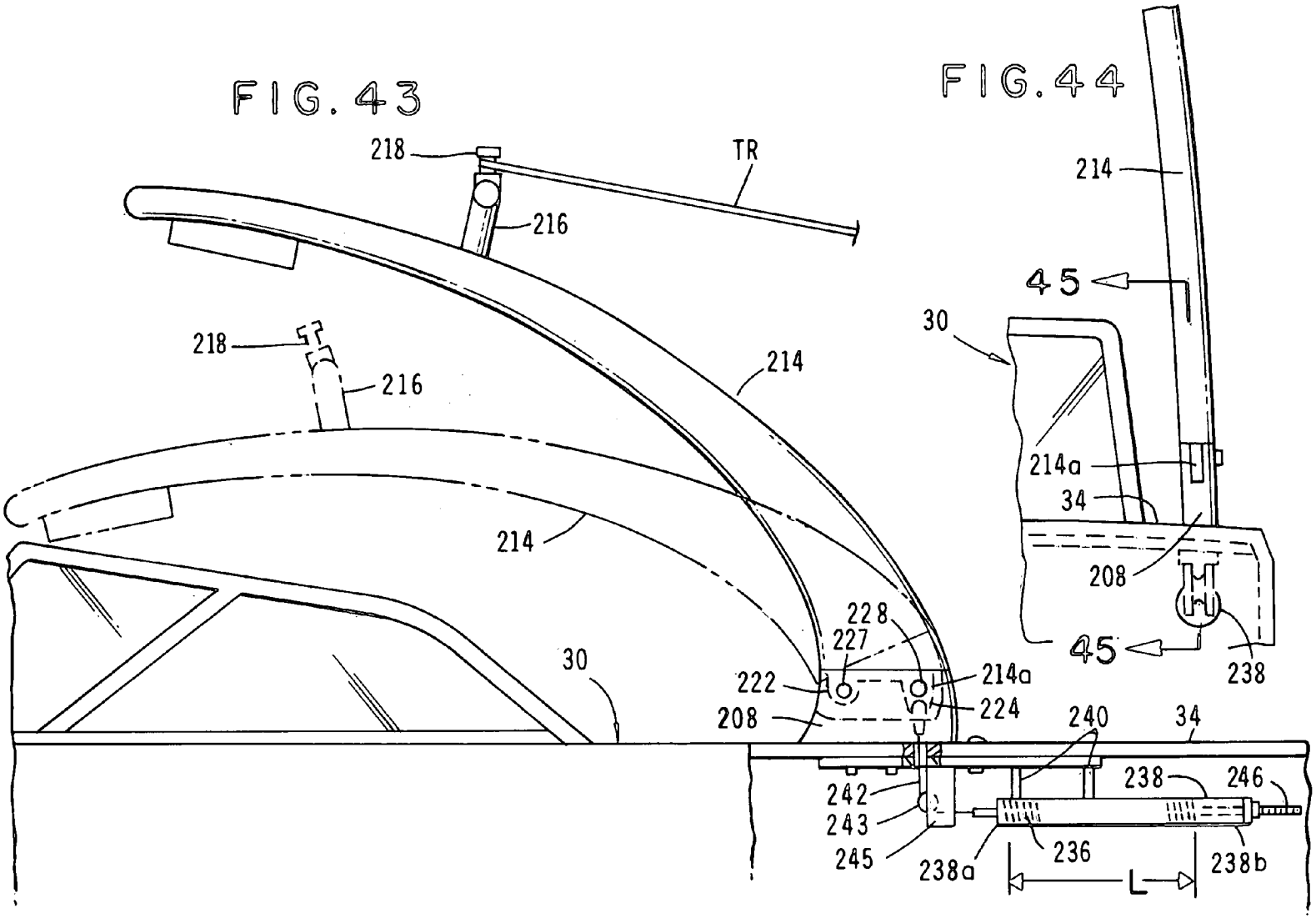
FIG. 43 is a fragmentary, side-elevational view of yet another form of the wake tower of the present invention shown affixed to the gunwales of a powerboat.
FIG. 44 is a fragmentary, front view of one side of the wake tower assembly shown in FIG. 43.

In this latest form of the invention, the wake tower further includes a tow rope connector member assembly 216 that includes a conventional type of connector 218 to which the tow rope "TR" can be connected (FIG. 43).

As illustrated in FIG. 45A, the base members are provided with spaced-apart first and second bores the purpose of which will presently be described and a cavity 220. Connector segments 214*a* are provided with a pair of spaced-apart, downwardly extending ears 222 and 224 that are receivable within the base member cavities. Downwardly extending ear 222 has a bore 222*a* formed therein and, similarly, the upper portion 224*a* of downwardly extending ear 224 has a bore 226 formed therein. Receivable within bore 222*a* is a pivot pin 227 about which the connector segments 214*a* can pivot in the manner illustrated by the phantom lines of FIG. 43. Pivot pin 227 extends through aligned bores formed in the base members.

Figure 46:
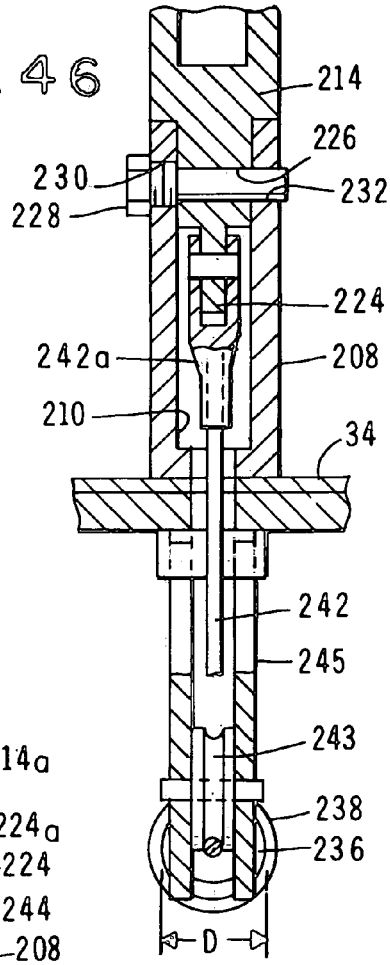
FIG. 46 is a cross-sectional view taken along lines 46—46 of FIG. 45A.

This latest embodiment of the invention includes novel locking means that is connected to second upwardly extending base connector 208 for locking the generally U-shaped upwardly extending assembly 214 against pivotal movement. This locking means here includes a locking pin 228 that is receivable within bore 226 formed in the upper portion 224*a* of downwardly extending ear 224 and within bores 230 and 232 formed in the base member 208 (FIG. 46). When locking pin 228 is in position within these openings in the manner shown in FIG. 46, pivotal movement of the structural assembly 214 is prevented. However, as indicated by the phantom lines in FIG. 43, when the locking pin 228 is removed from the base member 208, structural assembly 214 is free to pivot about pivot pin 227 in a direction toward the bow portion of the sports boat in the manner shown by the phantom lines in FIG. 43.

An important aspect of this latest embodiment of the invention is the provision of the previously mentioned counter-balancing means. This novel counter-balancing means functions to yieldably resist movement of the generally U-shaped, upwardly extending structural assembly toward said second lowered position and to assist in the movement of the structural assembly toward its first upright position. As best seen by referring to FIGS. 45A and 45B, this counter-balancing means here comprises an extendable, retractable coil spring 236 having a diameter "D" (FIG. 46) and a length "L" (FIG. 43). Coil spring 236 is operable associated with structural assembly 214 in the manner shown in FIG. 43.

The novel counter-balancing means of the invention further comprises an elongated, hollow housing 238, which closely receives therewithin coil spring 236 (see FIGS. 45A, 45B and 46). Hollow housing 238, which has first and second end portions 238*a* and 238*b* respectively, is connected to second gunwale 34 by means of a pair of spaced-apart, downwardly extending connector members 240, which are interconnected with the lower surface of gunwale 34 and with the upper surface of hollow housing 238 by any suitable means such as welding. Also forming a part of the novel counter-balancing means of the invention is an elongated connector cable 242. Connector cable 242, which is entrained about a pulley 243 that is rotatably connected to a pulley support member 245 that depends from the lower surface of the gunwale 34 and extends through opening 263 formed in the gunwale, has a first end 242*a* connected to the first extremity 236*a* of coil spring 236 and a second end 242*b* connected to the lower portion 244 of connector ear 224 (FIG. 45A).

The novel counter-balancing means of this latest form of the invention further comprises adjustment means for adjusting the length of coil spring 236. As best seen by referring to FIG. 45B, this important adjustment means here comprises an elongated, threaded adjustment rod 246 that is threadably connected to an end cap 248 that is affixed to the second end portion 238*b* of hollow housing 238. The inboard end 246*a* of adjustment rod 246 is interconnected with the second extremity 236*b* in the manner shown in FIG. 45B.

Figures 49, 50:
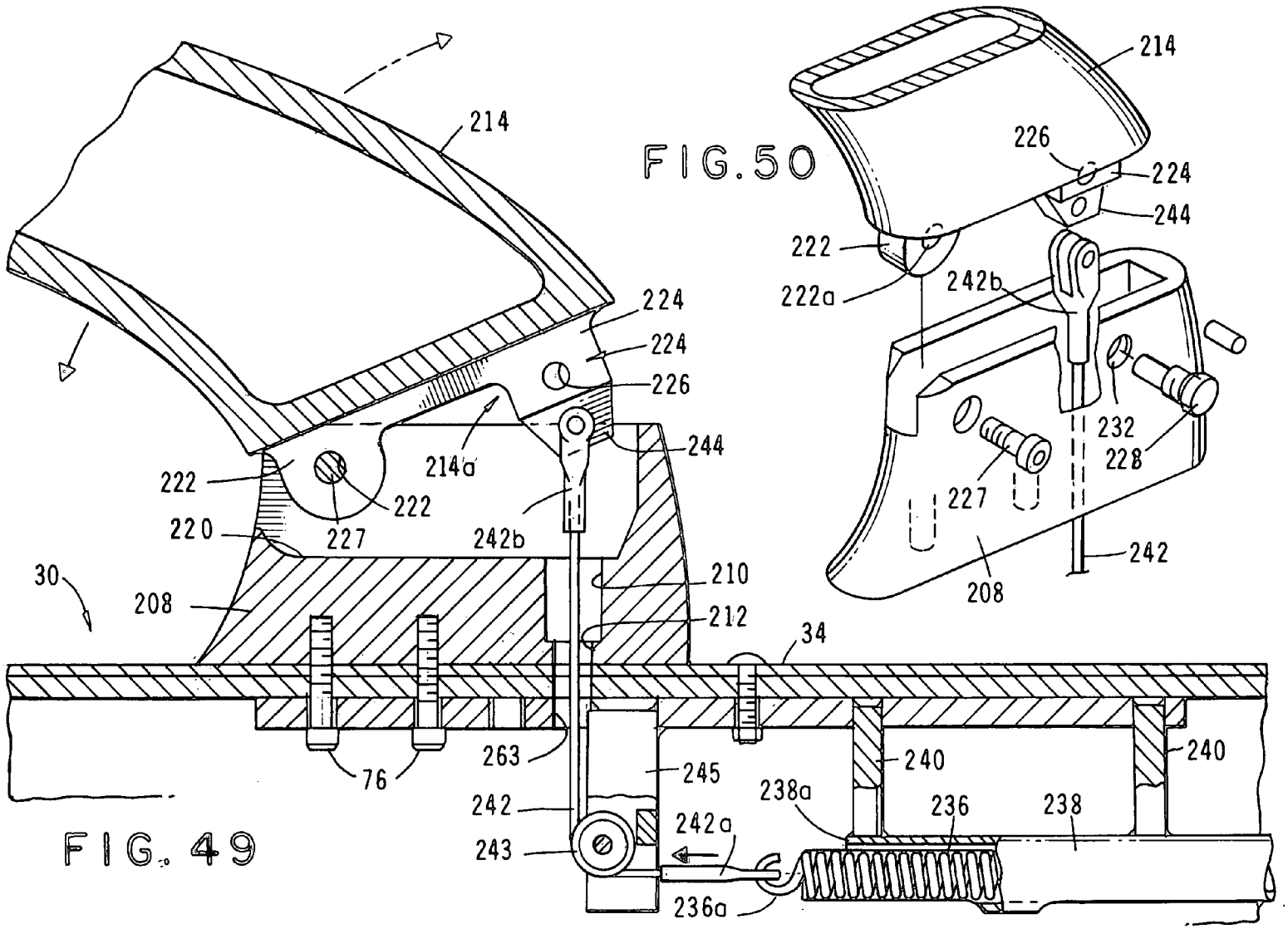
FIG. 49 is an enlarged, cross-sectional view, similar to FIG. 45A, but showing the generally U-shaped, upwardly extending assembly pivoted into a forwardly stowed position.
FIG. 50 is a generally perspective, exploded view of one of the base assemblies and the lower portion of one of generally U-shaped, upwardly extending assemblies of this latest form of the invention.

With the construction described in the preceding paragraphs, and as illustrated in FIG. 49 of the drawings, when the structural assembly is pivoted into its foreword stowed position, cable 242 will extend the length "L" of the coil spring 236 from its relaxed configuration shown in FIGS. 45A and 45B to its extended configuration shown in FIG. 49 and in so doing will offset the force generated by the structural assembly as it moves toward its stowed position. The coil spring will remain in its extended position so long as the structural assembly is in its stowed position and will then assist the operator in returning the structural assembly to its upright starting position by advantageously offsetting the weight of the structural assembly. The force exerted by the coil spring in assisting in the return of the structural assembly to its upright position, can be adjusted by increasing the length "L" of the coil spring. This is accomplished by rotating the threaded connector rod 246 in a clockwise direction relative to cap 248, which rotation extends the length of the coil spring in its starting position. With the coil spring in its initial extended configuration, movement of the structural assembly into its stowed configuration will load the spring in a manner to cause it to exert a greater assisting force when the structural assembly is returned to its upright starting configuration.

Turning to FIGS. 51 through 56, still another form of the wake tower of the invention is shown interconnected with a powerboat 30 of conventional construction having a bow portion and a stern portion. This embodiment is similar in many respects to the embodiment shown in FIGS. 43 through 50 and like numerals are used in FIGS. 51 through 56 to identify like components. One of the main differences between this latest form of the invention and the earlier described form is that the generally U-shaped upwardly extending assembly, instead of being pivotally movable in a direction toward the bow portion of the sports boat, is pivotally movable in a direction toward the stern portion of the boat. As in the earlier described embodiment of the invention, counter-balancing means are provided for yieldably resisting movement of the structural assembly toward its lowered, stowed position and for assisting in the return of the structural assembly to its upright starting position.

Figures 53, 55:
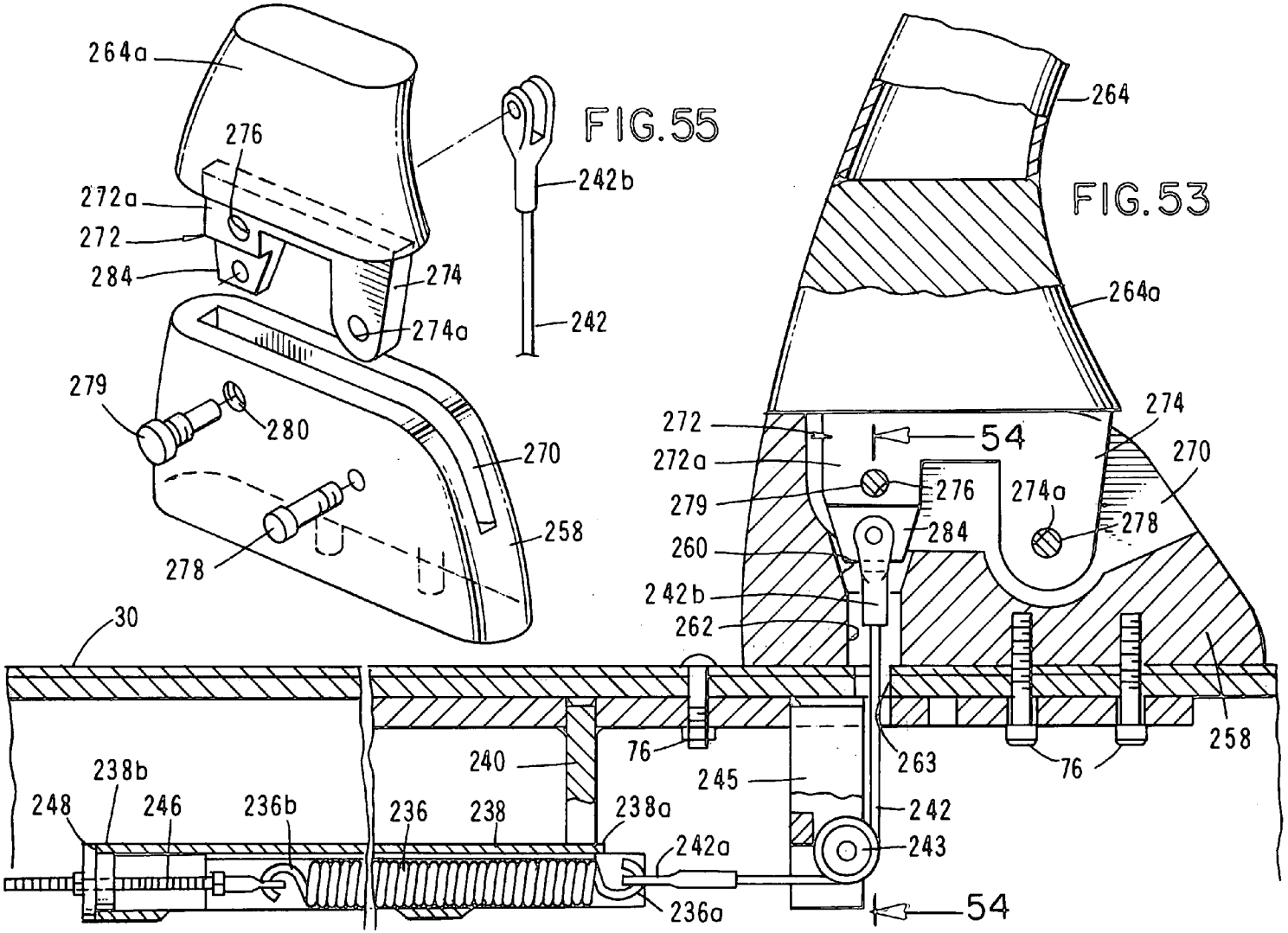
FIG. 53 is an enlarged, cross-sectional view taken along lines 53—53 of FIG. 52.
FIG. 55 is a generally perspective, exploded view of one of the base assemblies and the lower portion of one of generally U-shaped, upwardly extending assemblies of this latest form of the invention.

As before, this latest form of the invention includes a wake tower that comprises an upwardly extending first base member (not shown) connected to the first gunwale and an upwardly extending second base member 258 connected to said second gunwale 34. The base members are of basically the same curved configuration as in the last described embodiment, save that base member 258 is provided with a first tapered bore 260 and a second straight bore 262 that communicates with a bore 263 formed in gunwale 34 (FIG. 53). Interconnected with the base members is a generally U-shaped, upwardly extending structural assembly 264, which is of similar construction to that previously described. Structural assembly 264 here includes connector segments 264*a*, which are pivotally connected to the first and second base members.

Figures 51, 52:
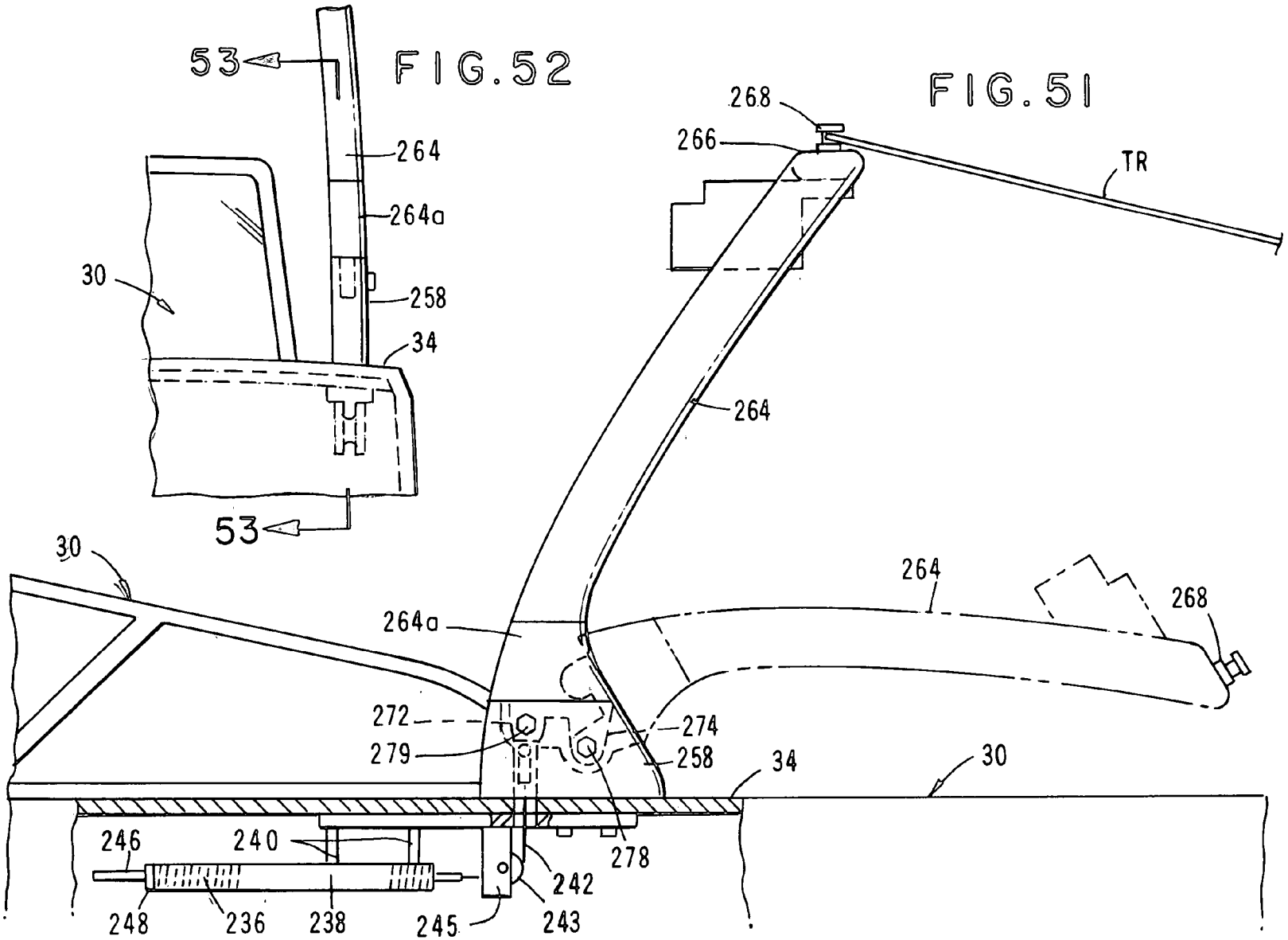
FIG. 51 is a fragmentary, side-elevational view of yet another form of the wake tower of the present invention shown affixed to the gunwales of a powerboat.
FIG. 52 is a fragmentary, front view of one side of the wake tower assembly shown in FIG. 51.

In this latest form of the invention, the wake tower further includes a tow rope connector member assembly 266 that includes a conventional type of connector 268 to which the tow rope "TR" can be connected (FIG. 51).

As illustrated in FIG. 53, the base members are provided with a cavity 270 and the connector segments 264*a* are provided with a pair of spaced-apart, downwardly extending ears 272 and 274 that are receivable within the base member cavities. Downwardly extending ear 274 has a bore 274*a* formed therein and, similarly, the upper portion 272*a* of downwardly extending ear 272 has a bore 276 formed therein. Receivable within bore 274*a* is a pivot pin 278 about which the connector segments 264*a* can pivot in the manner illustrated by the phantom lines of FIG. 51. Pivot pin 278 extends through aligned bores formed in the base members (see FIG. 55).

This latest embodiment of the invention also includes novel locking means that is connected to second upwardly extending base connector 258 for locking the generally U-shaped upwardly extending assembly 264 against pivotal movement. This locking means here includes a locking pin 279 that is receivable within bore 276 formed in the upper portion 272*a* of downwardly extending ear 272 and within bores 280 formed in the base member 258 (FIG. 55). When locking pin 279 is in position within these openings in the manner shown in FIG. 53, pivotal movement of the structural assembly 264 is prevented. However, as indicated by the phantom lines in FIG. 51, when the locking pin 279 is removed from the base member 258, structural assembly 264 is free to pivot about pivot pin 278 in the manner shown by the phantom lines in FIG. 51.

An important aspect of this latest embodiment of the invention is the provision of the previously mentioned counter-balancing means. This novel counter-balancing means, which is quite similar to that previously described, functions to yieldably resist movement of the generally U-shaped, upwardly extending structural assembly toward said second lowered position and to assist in the movement of the structural assembly toward its first upright position. As best seen by referring to FIG. 55, this counter-balancing means here comprises an extendable, retractable coil spring 236, which is identical in construction and operation to that previously described. Coil spring 236 is operable associated with structural assembly 264 in the manner shown in FIG. 53.

The novel counter-balancing means of the invention further comprises an elongated, hollow housing 238, which closely receives therewithin coil spring 236. Hollow housing 238, which has first and second end portions 238*a* and 238*b* respectively, is connected to second gunwale 34 by means of a pair of spaced-apart, downwardly extending connector members 240, which are interconnected with the lower surface of gunwale 34 and with the upper surface of hollow housing 238 by any suitable means such as welding (see FIGS. 51 and 53). Also forming a part of the novel counter-balancing means of the invention is an elongated connector cable 242. Connector cable 242, which is entrained about a pulley 243 that is rotatably connected to a pulley support member 245 that depends from the lower surface of the gunwale 34 and extends through opening 263 formed in the gunwale, has a first end 242*a* connected to the first extremity 236*a* of coil spring 236 and a second end 242*b* connected to the lower portion 284 of connector ear 272 (FIG. 53).

As in the last described embodiment of the invention, the novel counter-balancing means of this latest form of the invention further comprises adjustment means for adjusting the length of coil spring 236. This adjustment means is identical in construction and operation to that described in connection with the embodiment of FIGS. 43 through 50.

Figures 54, 56:
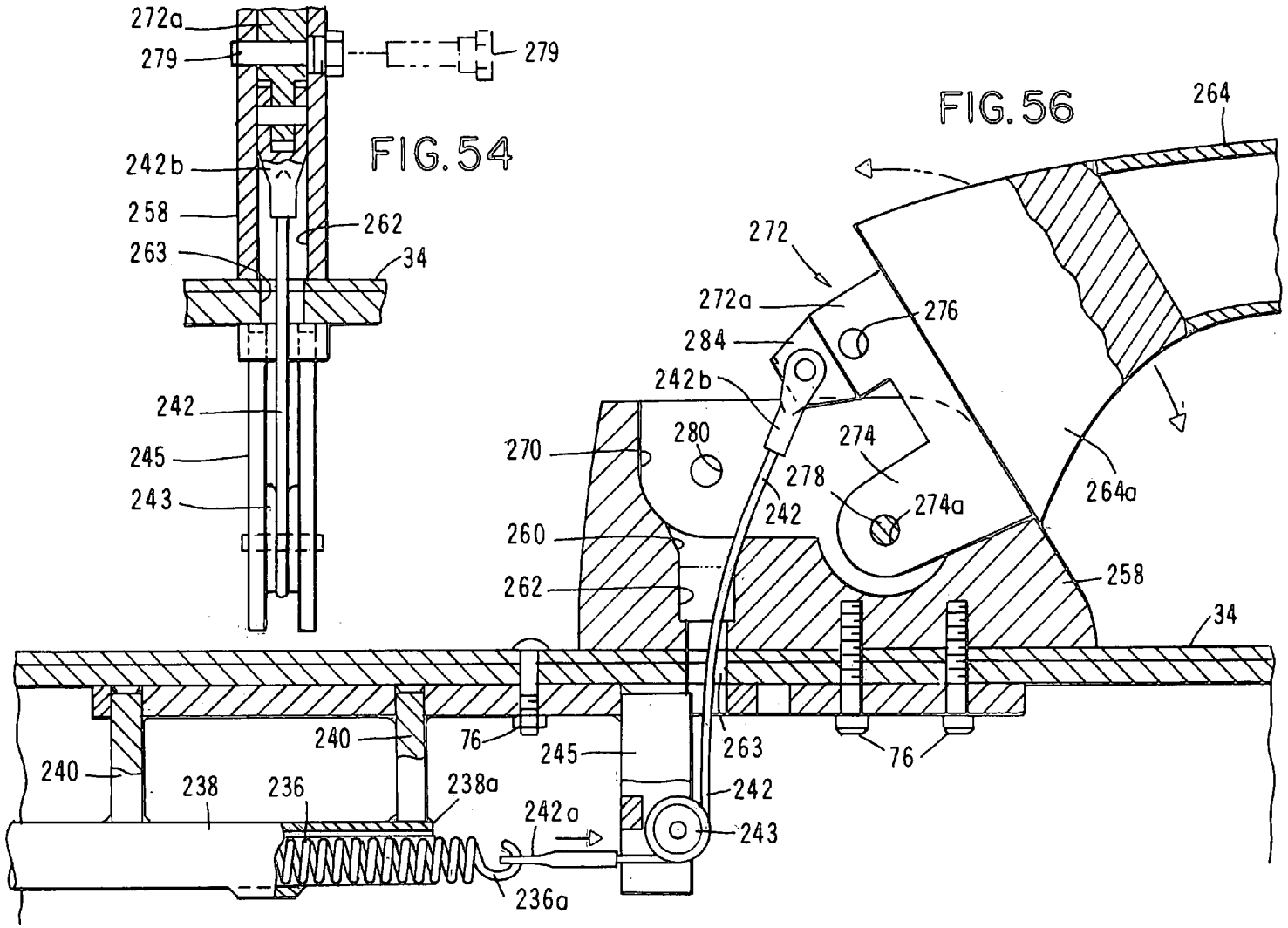
FIG. 54 is a cross-sectional view taken along lines 54—54 of FIG. 53.
FIG. 56 is an enlarged, cross-sectional view, similar to FIG. 53, but showing the generally U-shaped, upwardly extending assembly pivoted into a rearwardly stowed position.

With the construction described in the preceding paragraphs, and as illustrated in FIG. 56 of the drawings, when the structural assembly is pivoted into its rearward stowed position, cable 242 will extend the length of the coil spring 236 from its relaxed configuration shown in FIGS. 51 and 53 to its extended configuration shown in FIG. 56 and in so doing will offset the force generated by the structural assembly as it moves toward its stowed position. The coil spring will remain in its extended position so long as the structural assembly is in its stowed position and will then assist the operator in returning the structural assembly to its upright starting position by advantageously offsetting the weight of the structural assembly. The force exerted by the coil spring in assisting in the return of the structural assembly to its upright position, can be adjusted by increasing the length "L" of the coil spring. This is accomplished by rotating the threaded connector rod 246 in a clockwise direction relative to cap 248, which rotation extends the length of the coil spring in its starting position. With the coil spring in its initial extended configuration, movement of the structural assembly into its stowed configuration will load the spring in a manner to cause it to exert a greater assisting force when the structural assembly is returned to its upright starting configuration.

Figures 57, 58, 59:
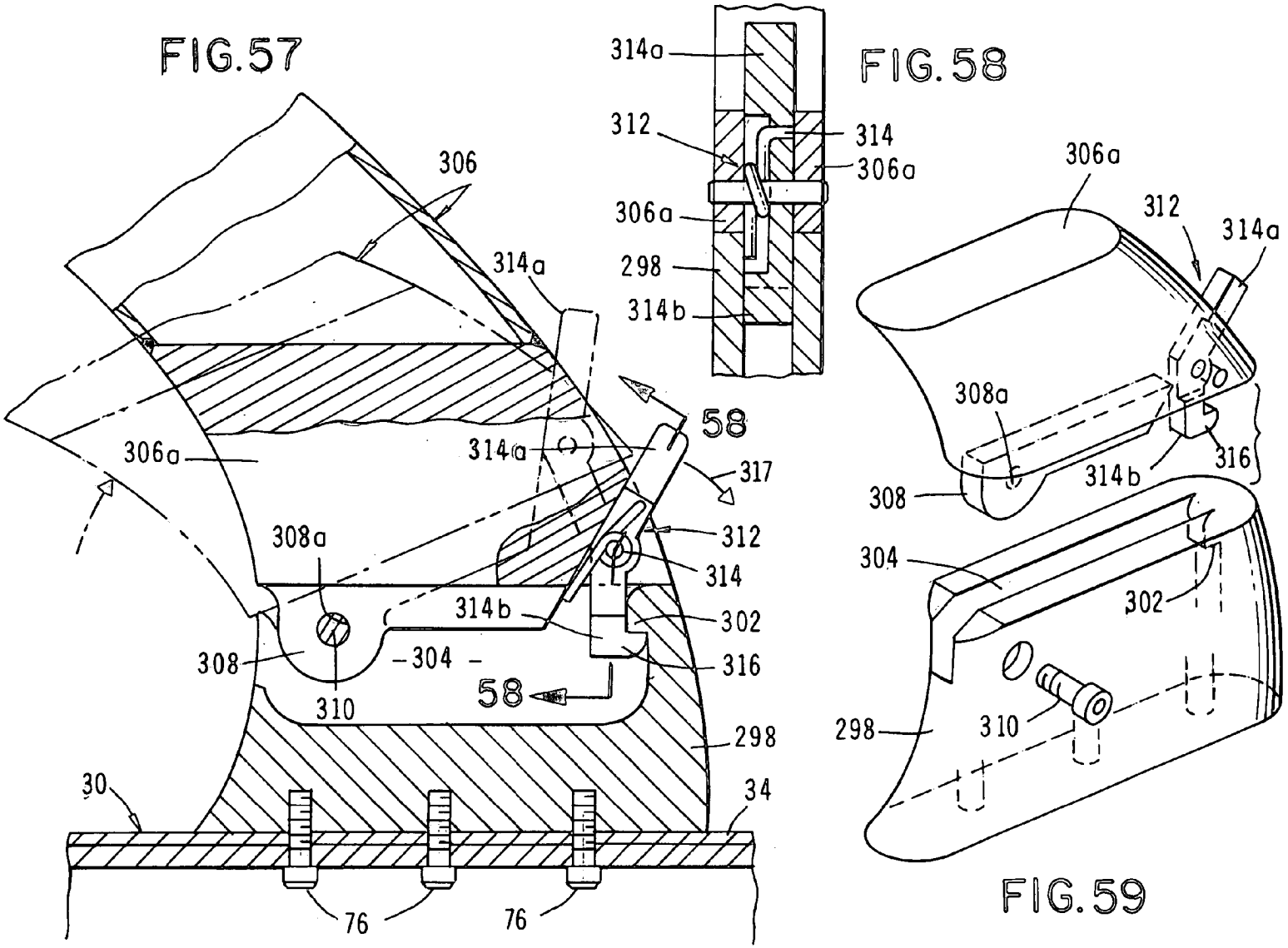
FIG. 57 is a fragmentary, side-elevational view of still another form of the wake tower of the present invention shown affixed to the gunwales of a powerboat.
FIG. 58 is an enlarged, cross-sectional view taken along lines 58—58 of FIG. 57.
FIG. 59 is a generally perspective, exploded view of one of the base assemblies and the lower portion of one of generally U-shaped, upwardly extending assemblies of this latest form of the invention.

Turning next to FIGS. 57 through 59, still another form of the wake tower of the invention is shown interconnected with a powerboat 30 of conventional construction having a bow portion and a stern portion. This embodiment is similar in some respects to the embodiment shown in FIGS. 1 through 11 and like numerals are used in FIGS. 57 through 59 to identify like components. The main difference between this latest form of the invention and the earlier described form resides in the provision of a totally different locking means that is operably associated with a selected one of the upwardly extending base connectors for locking the generally U-shaped upwardly extending assembly against pivotal movement.

As before, this latest form of the invention includes a wake tower that comprises an upwardly extending first base member (not shown) connected to the first gunwale and an upwardly extending second base member 298 connected to the second gunwale 34. The base members are of basically the same curved configuration as in the earlier described embodiment save that base member 298 is provided with a locking shoulder 302 that is disposed within a cavity 304 formed in the base member. Interconnected with the base members is a generally U-shaped, upwardly extending structural assembly 306, which is of similar construction to that previously described. Structural assembly 306 here includes connector segments 306*a* which are pivotally connected to the first and second base members.

As illustrated in FIG. 57, the connector segments 306*a* are provided with downwardly extending ears 308 that are receivable within the base member cavities 304. Downwardly extending ears 308 have a bore 308*a* formed therein. Receivable within bores 308*a* are pivot pins 310 (FIG. 59) about which the connector segments 306*a* can pivot in the manner illustrated by the phantom lines of FIG. 57. Pivot pins 310 extend through aligned bores formed in the base members.

This latest embodiment of the invention also includes the previously mentioned locking means that is connected to a selected one of the connector segments 306*a* for locking the generally U-shaped upwardly extending assembly 306 against pivotal movement. This novel locking means here includes a locking member 312 that is pivotally connected to connector segment 306*a* for movement between a first locked position shown in FIG. 57 and a second release position against the urging of a torsion spring 314. Locking member 312 here comprises a finger-engaging portion 314*a* and locking portion 314*b* (see FIG. 59) that extends into cavity 304 in a manner shown in FIG. 57. Locking portion 314*b* is provided with a hook-like extremity 316 that lockably engages shoulder 302 when the locking means is in the locking configuration shown in FIG. 57. Locking member 312 can be moved into the release position by exerting a downward force against the urging of torsion spring 314 in the direction of the arrow 317 of FIG. 57. With the locking member in the release position, the generally U-shaped, upwardly extending assembly 306 can be pivoted into the stowed position shown by the phantom lines in FIG. 57.

Referring now to FIGS. 60 through 63, still another form of the wake tower of the invention is shown interconnected with a powerboat 30 of conventional construction having a bow portion and a stem portion. This embodiment is also similar in some respects to the embodiment shown in FIGS. 1 through 11 and like numerals are used in FIGS. 60 through 63 to identify like components. The main difference between this latest form of the invention and the earlier described form resides in the provision of a still different locking means that is connected to one of the upwardly extending base connectors for locking the generally U-shaped upwardly extending assembly against pivotal movement.

As before, this latest form of the invention includes a wake tower that comprises an upwardly extending first base member (not shown) connected to the first gunwale and an upwardly extending second base member 318 connected to the second gunwale 34. The base members are of basically the same curved configuration as in the earlier described embodiment save that base member 318 is provided with a bore 320 that communicates with a cavity 324 formed in the base member. Interconnected with the base members is a generally U-shaped, upwardly extending structural assembly 326, which is of similar construction to that previously described. Structural assembly 326 here includes connector segments 326*a*, which are pivotally connected to the first and second base members.

Figures 60, 61, 62, 63:
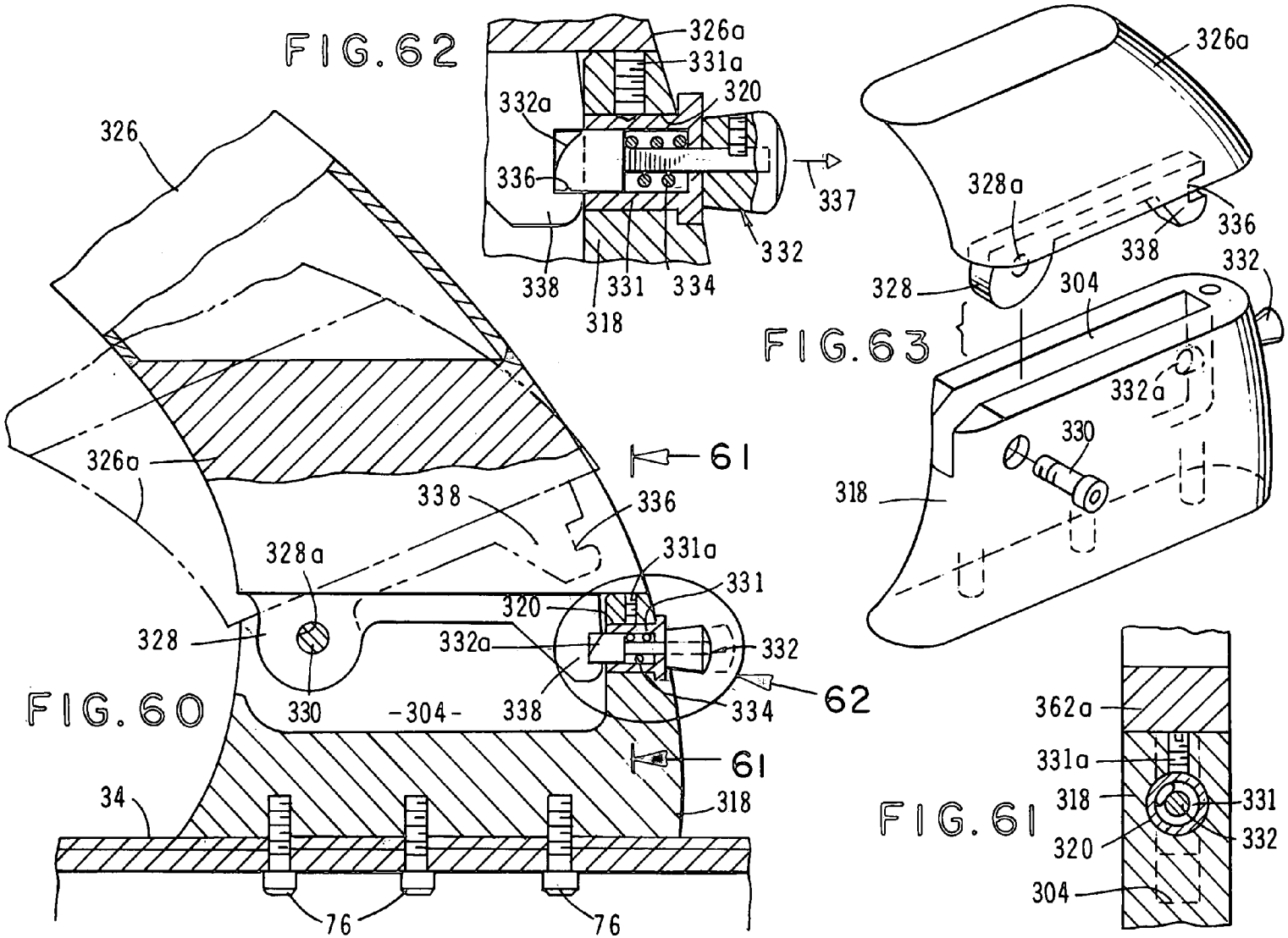
FIG. 60 is a fragmentary, side-elevational view of still another form of the wake tower of the present invention shown affixed to the gunwales of a powerboat.
FIG. 61 is an enlarged, cross-sectional view taken along lines 61—61 of FIG. 60.
FIG. 62 is an enlarged, cross-sectional view of the area designated in FIG. 60 as "62".
FIG. 63 is a generally perspective, exploded view of one of the base assemblies and the lower portion of one of generally U-shaped, upwardly extending assemblies of this latest form of the invention.

As illustrated in FIG. 60, the connector segments 326*a* are provided with downwardly extending ears 328 that are receivable within the base member cavities 304. Downwardly extending ears 328 have a bore 328*a* formed therein. Receivable within bores 328*a* are pivot pins 330 (FIGS. 60 and 63) about which the connector segments 326*a* can pivot in the manner illustrated by the phantom lines of FIG. 60. Pivot pins 330 extend through aligned bores formed in the base members.

This latest embodiment of the invention also includes the previously mentioned locking means that is connected to a selected one of the base members for locking the generally U-shaped upwardly extending assembly 326 against pivotal movement. This novel locking means here includes a locking pin 332 that is telescopically received within a sleeve 331 which is disposed within bore 320 for movement against the urging of a coil spring 334 from the first inward position shown in FIG. 60 to the second release position shown by the phantom lines in FIG. 60. A set screw 331*a* retains sleeve 331 in position within bore 320. When the locking pin 332 is in the inward, locking position, the inboard end 332*a* thereof lockably engages a notch 336 formed in a downwardly extending ear 338 formed on connector segment 326*a* preventing pivotal movement of assembly 326. When it is desired to pivot the U-shaped assembly 326 into its stowed position an outward force exerted on pin 332 in the direction of the arrow 337 of FIG. 62 will move the pin into the release position wherein end 332*a* moves out of notch 336 formed in ear 338.

Figure 66:
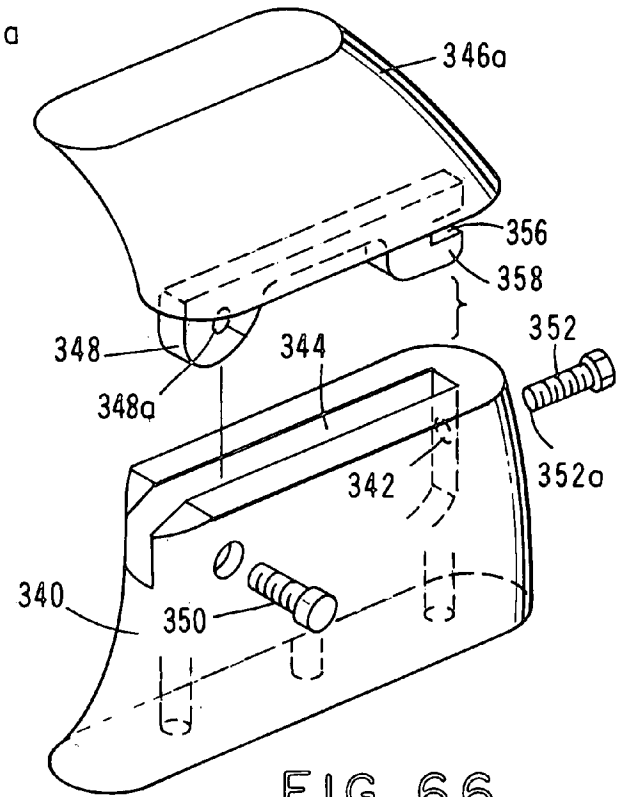
FIG. 66 is a generally perspective, exploded view of one of the base assemblies and the lower portion of one of generally U-shaped, upwardly extending assemblies of this latest form of the invention.
Figure 65:
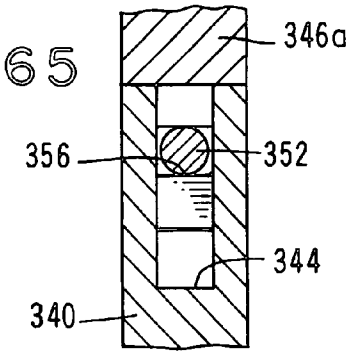
FIG. 65 is an enlarged, cross-sectional view taken along lines 65—65 of FIG. 64.
Figure 64:
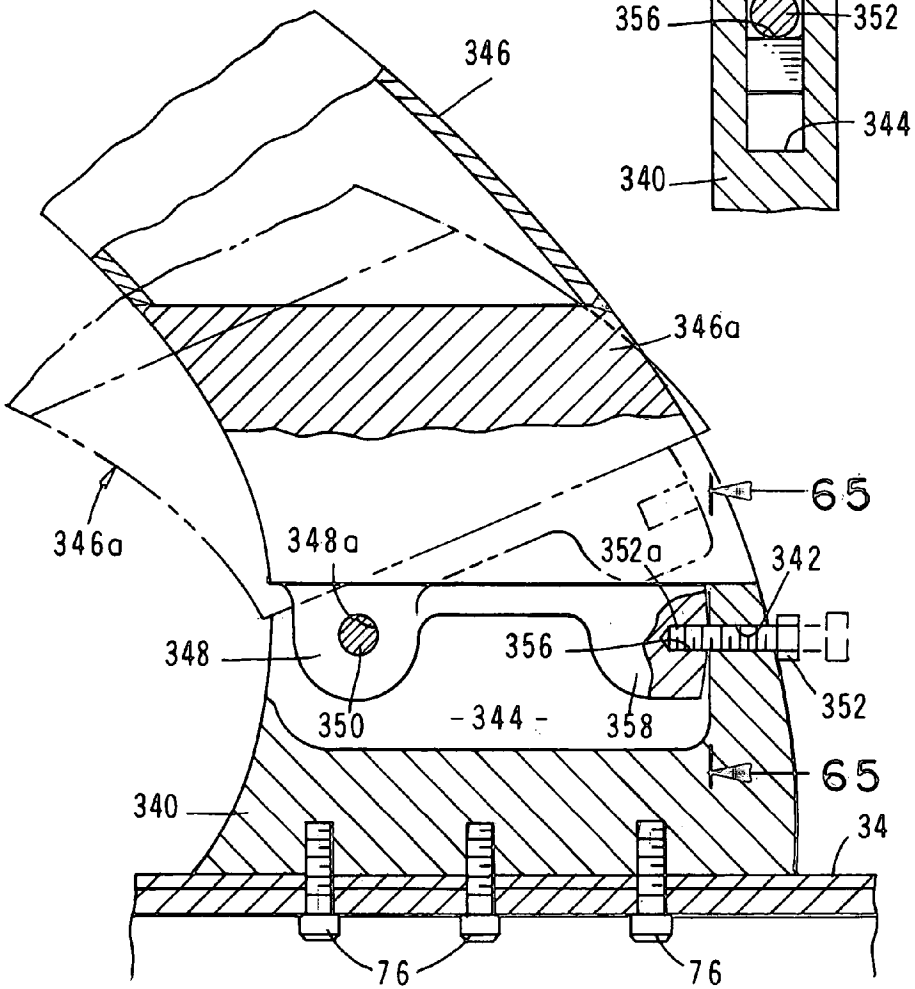
FIG. 64 is a fragmentary, side-elevational view of yet another form of the wake tower of the present invention shown affixed to the gunwales of a powerboat.

Turning next to FIGS. 64 through 66, still another form of the wake tower of the invention is shown interconnected with a powerboat 30 of conventional construction having a bow portion and a stem portion. This embodiment is similar in some respects to the embodiment shown in FIGS. 60 through 63 and like numerals are used in FIGS. 64 through 66 to identify like components. The main difference between this latest form of the invention and the earlier described form resides in the provision of a still different type of locking means that is operably associated with a selected one of the upwardly extending base connectors for locking the generally U-shaped upwardly extending assembly against pivotal movement.

As before, this latest form of the invention includes a wake tower that comprises an upwardly extending first base member (not shown) connected to the first gunwale and an upwardly extending second base member 340 connected to the second gunwale 34. The base members are of basically the same curved configuration as in the earlier described embodiment save that base member 340 is provided with a threaded bore 342 that communicates with a cavity 344 formed in the base member. Interconnected with the base members is a generally U-shaped, upwardly extending structural assembly 346, which is of similar construction to that previously described. Structural assembly 346 here includes connector segments 346*a* which are pivotally connected to the first and second base members.

As illustrated in FIG. 64, the connector segments 346*a* are provided with downwardly extending ears 348 that are receivable within the base member cavities 344. Downwardly extending ears 348 have a bore 348*a* formed therein. Receivable within bores 348*a* are pivot pins 350 (FIGS. 64 and 66) about which the connector segments 346*a* can pivot in the manner illustrated by the phantom lines of FIG. 64. Pivot pins 350 extend through aligned bores formed in the base members.

This latest embodiment of the invention also includes the previously mentioned locking means that is connected to a selected one of the base members for locking the generally U-shaped upwardly extending assembly 346 against pivotal movement. This novel locking means here includes a threaded locking screw 352 that is threadably received within threaded bore 342 formed in base member 340. Locking screw 352 is movable from the first inward position shown in FIG. 64 to the second release position shown by the phantom lines in FIG. 64. When the locking screw 352 is in the inward, locking position, the inboard end 352*a* thereof lockably engages a notch 356 formed in a downwardly extending ear 358 formed on connector segment 346*a* preventing pivotal movement of assembly 346. When it is desired to pivot the U-shaped assembly 346 into its stowed position, locking screw 352 can be rotated in a counterclockwise direction so as to move the locking screw into the release position wherein end 352*a* moves out of notch 356 formed in ear 358.

Figure 69:
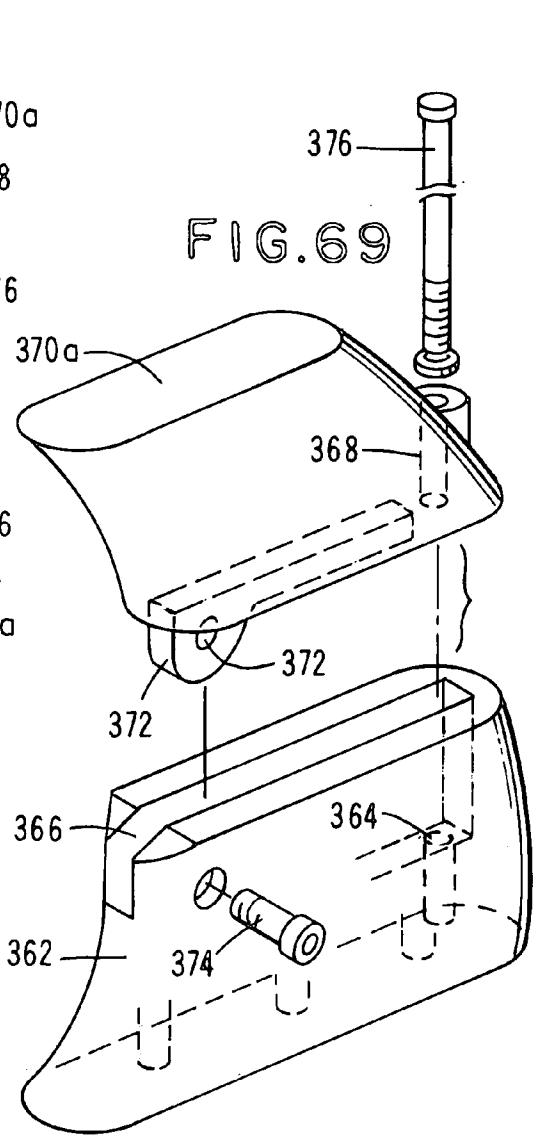
FIG. 69 is a generally perspective, exploded view of one of the base assemblies and the lower portion of one of generally U-shaped, upwardly extending assemblies of this latest form of the invention.
Figure 68:
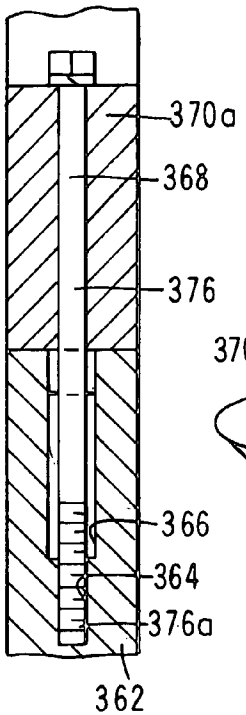
FIG. 68 is an enlarged, cross-sectional view taken along lines 68—68 of FIG. 67.
Figure 67:
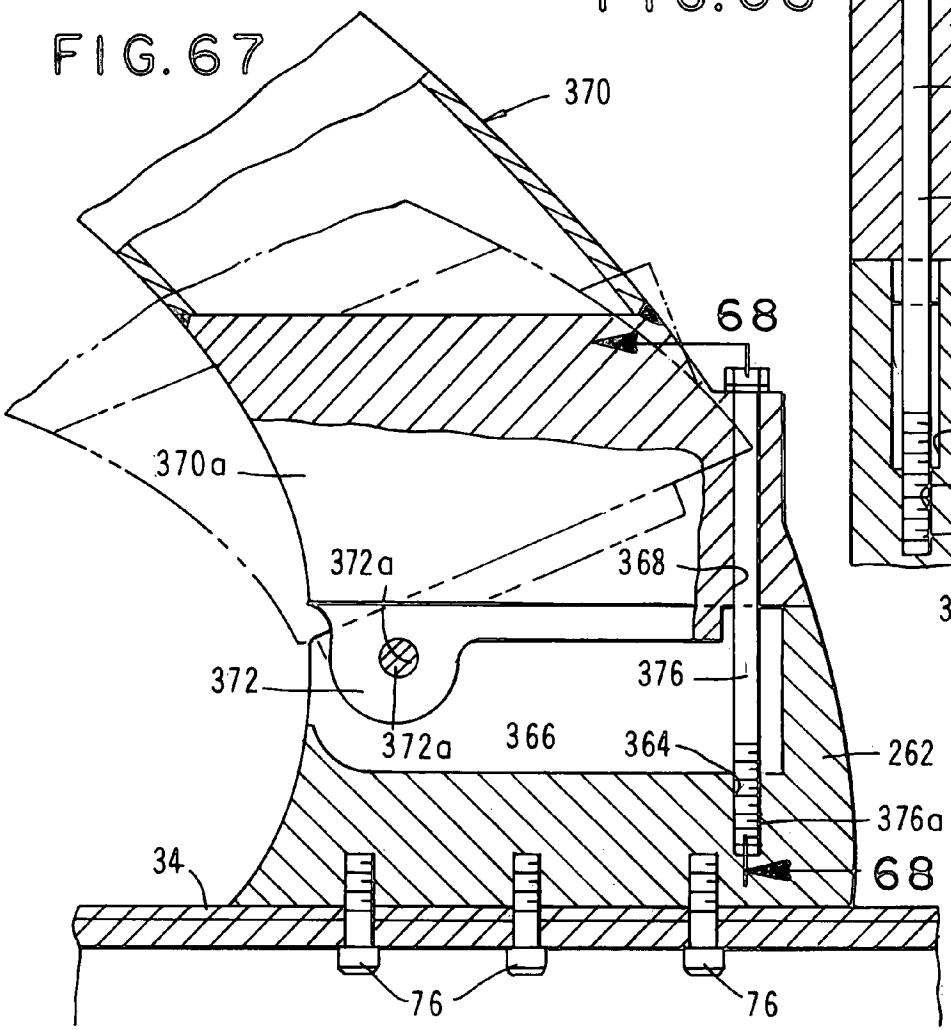
FIG. 67 is a fragmentary, side-elevational view of still another form of the wake tower of the present invention shown affixed to the gunwales of a powerboat.

Turning next to FIGS. 67 through 69, yet another form of the wake tower of the invention is shown interconnected with a powerboat 30 of conventional construction having a bow portion and a stem portion. This embodiment is similar in some respects to the embodiment shown in FIGS. 64 through 66 and like numerals are used in FIGS. 67 through 69 to identify like components. The main difference between this latest form of the invention and the earlier described form resides in the provision of a yet another type of locking means that is operably associated with a selected one of the upwardly extending base connectors for locking the generally U-shaped upwardly extending assembly against pivotal movement.

As before, this latest form of the invention includes a wake tower that comprises an upwardly extending first base member (not shown) connected to the first gunwale and an upwardly extending second base member 362 connected to the second gunwale 34. The base members are of basically the same curved configuration as in the earlier described embodiment save that base member 362 is provided with a generally vertically extending threaded bore 364 that communicates with a cavity 366 formed in the base member and also with a bore 368 formed in the generally U-shaped upwardly extending assembly 370 that is interconnected with base member 362, which is of similar construction to that previously described. Structural assembly 374 here includes connector segments 374*a*, which are pivotally connected the first and second base members.

As illustrated in FIG. 67, the connector segments 370*a* are provided with downwardly extending ears 372 that are receivable within the base member cavities 366. Downwardly extending ears 372 have a bore 372*a* formed therein. Receivable within bores 372*a* are pivot pins 374 (FIGS. 64 and 66) about which the connector segments 370*a* can pivot in the manner illustrated by the phantom lines of FIG. 67. As before, pivot pins 374 extend through aligned bores formed in the base members.

This latest embodiment of the invention also includes the previously mentioned locking means that is connected to a selected one of the base members for locking the generally U-shaped upwardly extending assembly 370 against pivotal movement. This novel locking means here includes an elongated, generally vertically extending threaded locking screw 376 the lower end 376*a* of which is threadably received within threaded bore 364 formed in base member 362. Locking screw 376 is telescopically movable within generally vertically extending bore 368 from the first downward most locking position shown in FIGS. 67 and 68 to a second, upward release position. When the locking screw 376 is in the downward, locking position, pivotal movement of assembly 370 is effectively prevented. When it is desired to pivot the U-shaped assembly 370 into its stowed position, locking screw 376 can be rotated in a counterclockwise direction so as to move the locking screw into the upward, release position wherein end 376*a* moves out of threaded bore 364.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In combination, a sports boat having first and second spaced-apart gunwales, each having upper and lower surfaces, a bow portion and a stem portion, a wake tower, said wake tower comprising:

(a) an upwardly extending first base connector connected to the first gunwale of the sports boat;

(b) an upwardly extending second base connector connected to said second gunwale of the sports boat;

(c) a generally U-shaped, upwardly extending structural assembly pivotally connected to said first and second base connectors for movement between a first upright position and a second lowered position; and (d) counter-balancing means mounted on the lower surface of a selected one of said first and second gunwales for yieldably resisting movement of said generally U-shaped, upwardly extending structural assembly toward said second lowered position and for assisting in the movement of said generally U-shaped, upwardly extending structural assembly toward said first upright position.

2. The combination as defined in claim 1 in which said counter-balancing means comprises a spring operably associated with generally U-shaped, upwardly extending structural assembly.

3. The combination as defined in claim 2 in which said spring comprises an extendable, retractable coil spring having a diameter and a length.

4. The combination as defined in claim 3 in which said counter-balancing means further comprises:

(a) an elongated, hollow housing for receiving said coil spring therewithin, said hollow being connected to said one of said first and second gunwales and having first and second end portions; and (b) an elongated connector cable having a first end connected to said coil spring and a second end connected to said generally U-shaped, upwardly extending structural assembly.

5. The combination as defined in claim 4 in which said counter-balancing means further comprises adjustment means connected to said second end portion of said hollow housing for adjusting the length of said coil spring.

6. The combination as defined in claim 4 in which each of said base connectors and said side connectors includes first and second spaced-apart bores.

7. The combination as defined in claim 6 further including a pivot pin received within said first spaced-apart bores and a locking bolt received within said second spaced-apart bores.

8. The combination as defined in claim 7 in which said generally U-shaped upwardly extending assembly is pivotally movable in a direction toward the bow portion of the sports boat.

9. The combination as defined in claim 7 in which said generally U-shaped upwardly extending assembly is pivotally movable in a direction toward the stern portion of the sports boat.

10. In combination, a sports boat having first and second spaced-apart gunwales, each having upper and lower surfaces, a bow portion and a stern portion a wake tower, said wake tower comprising:

(a) an upwardly extending first base connector connected to the first gunwale of the sports boat;

(b) an upwardly extending second base connector connected to said second gunwale of the sports boat;

(c) a generally U-shaped, upwardly extending structural assembly pivotally connected to said the first and second base connectors for movement between an erected position and a stowed position; and (d) counter-balancing means mounted on the lower surface of a selected one of said first and second gunwales for yieldably resisting movement of said generally U-shaped, upwardly extending structural assembly toward said second lowered position and for assisting in the movement of said generally U-shaped, upwardly extending structural assembly toward said first upright position.

11. The combination as defined in claim 10 in which said counter-balancing means comprises an extendable, retractable coil spring having a diameter and a length.

12. The combination as defined in claim 11 in which said counter-balancing means further comprises:

(a) an elongated, hollow housing for receiving said coil spring therewithin, said hollow being connected to said one of said first and second gunwales and having first and second end portions; and (b) an elongated connector cable having a first end connected to said coil spring and a second end connected to said generally U-shaped, upwardly extending structural assembly.

13. The combination as defined in claim 12 in which said counter-balancing means further comprises adjustment means connected to said second end portion of said hollow housing for adjusting the length of said coil spring.

14. The combination as defined in claim 13 in which said adjustment means comprises a threaded rod connected to said coil spring and threadably connected to second end portion of said hollow housing.

15. The combination as defined in claim 13 in which said generally U-shaped upwardly extending assembly is pivotally movable in a direction toward the bow portion of the sports boat.

16. The combination as defined in claim 13, further including locking means operably associated with said generally U-shaped upwardly extending assembly for locking said generally U-shaped upwardly extending assembly against pivotal movement.

17. The combination as defined in claim 16 in which a selected one of said first and second upwardly extending base connectors has a threaded bore and in which said locking means comprises:

(a) a locking screw threadably received in said threaded bore, said locking screw having an inboard end; and (b) a downwardly extending ear connected to said upwardly extending structural assembly, said downwardly extending ear having a notch for receiving said inboard end of said locking screw.

18. The combination as defined in claim 16 in which a selected one of said first and second upwardly extending base connectors has a pin receiving bore and said locking means comprises:

(a) a locking pin telescopically received within said pin receiving bore, said locking pin having an inboard end; and (b) a downwardly extending ear connected to said upwardly extending structural assembly, said downwardly extending ear having a notch for receiving said inboard end of said locking pin.

19. The combination as defined in claim 16 in which a selected one of said first and second upwardly extending base connectors has a locking shoulder and in which said locking means comprises a locking member pivotally connected to said generally U-shaped upwardly extending assembly for movement between first and a second positions, said locking member comprising a finger-engaging portion and locking portion for lockably engaging said locking shoulder when said locking member is in said second position.

20. The combination as defined in claim 16 in which a selected one of said first and second upwardly extending base connectors has a threaded bore and in which said locking means comprises:

(a) an elongated, generally vertically extending locking screw having an inboard end threadably received in said threaded bore; and (b) a downwardly extending bore formed in said upwardly extending structural assembly for telescopically receiving said locking screw.

21. In combination, a sports boat having first and second spaced-apart gunwales, a bow portion and a stem portion, a wake tower, said wake tower comprising:

(a) an upwardly extending first base connector connected to the first gunwale of the sports boat;

(b) an upwardly extending second base connector connected to said second gunwale of the sports boat;

(c) an upwardly extending structural assembly comprising a first curved side connected to said first base connector, a second curved side connected to said second base connector, each of said curved sides including a side connector pivotally connected to said base connector; and (d) locking means operably associated with said upwardly extending structural assembly for locking said side connector against pivotal movement.

22. The combination as defined in claim 21 in which a selected one of said first and second upwardly extending base connectors has a threaded bore and in which said locking means comprises:

(a) a locking screw threadably received in said threaded bore, said locking screw having an inboard end; and (b) a downwardly extending ear connected to said side connector, said downwardly extending ear having a notch for receiving said inboard end of said locking screw.

23. The combination as defined in claim 21 in which said selected one of said first and second upwardly extending base connectors has a pin receiving bore and in which said locking means comprises:

(a) a locking pin telescopically received within said pin receiving bore, said locking pin having an inboard end; and (b) a downwardly extending ear connected to said side connector, said downwardly extending ear having a notch for receiving said inboard end of said locking pin.

24. The combination as defined in claim 21 in which a selected one of said first and second upwardly extending base connectors has a threaded bore and in which said locking means comprises:

(a) an elongated, generally vertically extending locking screw having an inboard end threadably received in said threaded bore; and (b) a downwardly extending bore formed in said upwardly extending structural assembly for telescopically receiving said locking screw.

25. The combination as defined in claim 21 in which said locking means comprises a locking member pivotally connected to said side connector.

26. The combination as defined in claim 25 in which a selected one of said first and second upwardly extending base connectors has a cavity and in which said locking member comprises a finger-engaging portion and locking portion extending into said cavity of said selected one of said first and second upwardly extending base connectors.

* * * * *